US011000866B2

(12) United States Patent
Shadbolt et al.

(10) Patent No.: US 11,000,866 B2
(45) Date of Patent: May 11, 2021

(54) ROTARY NOZZLES AND DEFLECTORS

(71) Applicant: RAIN BIRD CORPORATION, Azusa, CA (US)

(72) Inventors: Lee James Shadbolt, Tucson, AZ (US); David Eugene Robertson, Glendora, CA (US)

(73) Assignee: RAIN BIRD CORPORATION, Azusa, CA (US)

( * ) Notice: Subject to any disclaimer, the term of this patent is extended or adjusted under 35 U.S.C. 154(b) by 0 days.

(21) Appl. No.: 16/243,580

(22) Filed: Jan. 9, 2019

(65) Prior Publication Data

US 2020/0215557 A1 Jul. 9, 2020

(51) Int. Cl.

| | |
|---|---|
| ***B05B 3/00*** | (2006.01) |
| ***B05B 3/02*** | (2006.01) |
| ***B05B 3/04*** | (2006.01) |
| ***B05B 1/26*** | (2006.01) |

(52) U.S. Cl.

CPC ..... *B05B 3/021* (2013.01); *B05B 1/267* (2013.01); *B05B 3/003* (2013.01); *B05B 3/0486* (2013.01)

(58) Field of Classification Search

CPC ..... B05B 1/267; B05B 3/003; B05B 3/021; B05B 3/0486

USPC ..... 239/222.11–222.17

See application file for complete search history.

(56) References Cited

U.S. PATENT DOCUMENTS

| | | | | |
|---|---|---|---|---|
| 581,252 | A | 4/1897 | Quayle | |
| 598,873 | A * | 2/1898 | Joy | B05B 1/265 239/498 |
| 1,286,333 | A | 12/1918 | Johnson | |
| 3,030,032 | A | 4/1962 | Juhman, Jr. | |
| 4,099,675 | A | 7/1978 | Wohler | |
| 4,235,379 | A | 11/1980 | Beamer | |
| 4,261,515 | A | 4/1981 | Rosenberg | |
| 4,471,908 | A | 9/1984 | Hunter | |
| 4,512,519 | A | 4/1985 | Uzrad | |

(Continued)

FOREIGN PATENT DOCUMENTS

| | | |
|---|---|---|
| DE | 19925279 | 12/1999 |
| FR | 2730901 | 9/1997 |

(Continued)

OTHER PUBLICATIONS

U.S. Appl. No. 15/649,072; Office Action dated Nov. 19, 2020 (pp. 1-17).

(Continued)

*Primary Examiner* — Viet Le

(74) *Attorney, Agent, or Firm* — Fitch, Even, Tabin & Flannery LLP

(57) ABSTRACT

Rotary nozzles and deflectors for use with rotary nozzles are provided. The deflector includes a number of flutes that deliver fluid streams radially outwardly from the deflector. Fluid striking the flutes of the deflector cause the deflector to rotate, and the flutes subdivide fluid impacting deflector into multiple fluid streams that are distributed radially outwardly to surrounding terrain as the deflector rotates. Each of the flutes have the same curvature, although they may have different inclinations to distribute fluid streams at different trajectories. The flutes may also include blocking and downward-facing features at the ends of the flutes to improve the evenness of the fluid distribution in the irrigation coverage area.

24 Claims, 18 Drawing Sheets

(56) References Cited

U.S. PATENT DOCUMENTS 4,632,312 A * 12/1986 Premo ..... B05B 3/0472 185/45
4,681,263 A 7/1987 Cockman
4,711,399 A 12/1987 Rosenberg
4,728,040 A 3/1988 Healy
4,754,925 A 7/1988 Rubinstein
4,760,958 A 8/1988 Greenberg
4,783,004 A 11/1988 Lockwood
4,796,811 A * 1/1989 Davisson ..... B05B 3/005 239/222.17
4,815,662 A 3/1989 Hunter
4,817,869 A 4/1989 Rubinstein
4,832,264 A 5/1989 Rosenberg
4,842,201 A 6/1989 Hunter
4,867,379 A 9/1989 Hunter
4,898,332 A 2/1990 Hunter
4,932,590 A 6/1990 Hunter
4,944,456 A 7/1990 Zakai
4,957,240 A 9/1990 Rosenberg
4,961,534 A 10/1990 Tyler
4,967,961 A * 11/1990 Hunter ..... B05B 3/0454 239/240
5,031,840 A 7/1991 Grundy
5,050,800 A 9/1991 Lamar
5,058,806 A 10/1991 Rupar
5,152,458 A 10/1992 Curtis
5,158,232 A 10/1992 Tyler
5,205,491 A 4/1993 Hadar
5,226,602 A 7/1993 Cochran
5,288,022 A * 2/1994 Sesser ..... B05B 3/005 239/205
5,360,167 A 11/1994 Grundy
5,381,960 A 1/1995 Sullivan
5,415,348 A 5/1995 Nelson
5,439,174 A 8/1995 Sweet
5,456,411 A 10/1995 Scott
5,588,595 A 12/1996 Sweet
5,669,449 A 9/1997 Polan
5,671,886 A * 9/1997 Sesser ..... B05B 3/005 239/222.21
5,699,962 A 12/1997 Scott
5,718,381 A 2/1998 Katzer
5,762,269 A 6/1998 Sweet
6,059,044 A 5/2000 Fischer
6,085,995 A 7/2000 Kah
6,092,739 A 7/2000 Clearman
6,123,272 A 9/2000 Havican
6,234,411 B1 5/2001 Walker
6,254,013 B1 7/2001 Clearman
6,267,299 B1 7/2001 Meyer
6,276,460 B1 8/2001 Pahila
6,341,733 B1 1/2002 Sweet
6,435,427 B1 8/2002 Conroy
6,439,477 B1 * 8/2002 Sweet ..... B05B 3/008 239/214
6,481,644 B1 11/2002 Olsen
6,516,893 B2 2/2003 Pahila
6,651,904 B2 11/2003 Roman
6,651,905 B2 11/2003 Sesser
6,688,539 B2 * 2/2004 Vander Griend ..... B05B 3/0486 239/214.13
6,736,332 B2 5/2004 Sesser
6,811,098 B2 11/2004 Drechsel
6,814,304 B2 11/2004 Onofrio
6,834,816 B2 12/2004 Kah, Jr.
6,883,727 B2 4/2005 De Los Santos
6,942,164 B2 * 9/2005 Walker ..... B05B 3/005 239/204
6,976,543 B1 12/2005 Fischer
7,032,836 B2 4/2006 Sesser
7,100,842 B2 9/2006 Meyer
7,143,957 B2 12/2006 Nelson
7,143,962 B2 12/2006 Kah, Jr.
7,156,322 B1 1/2007 Heitzman
7,159,795 B2 1/2007 Sesser
7,168,634 B2 1/2007 Onofrio
7,232,081 B2 6/2007 Kah
7,240,860 B2 7/2007 Griend
7,395,977 B2 7/2008 Pinch
7,584,904 B2 9/2009 Townsend
7,597,273 B2 10/2009 McAfee
7,597,276 B2 * 10/2009 Hawkins ..... B05B 1/3006 239/518
7,611,077 B2 11/2009 Sesser
7,624,935 B2 12/2009 Nelson
7,703,706 B2 4/2010 Walker
D615,152 S 5/2010 Kah
7,717,361 B2 5/2010 Nelson
7,789,323 B2 * 9/2010 Nelson ..... B05B 3/0486 239/222.11
D628,272 S 11/2010 Kah
D636,459 S 4/2011 Kah
7,942,345 B2 5/2011 Sesser
7,954,731 B2 * 6/2011 Antonucci ..... B05B 3/003 239/230
7,980,488 B2 * 7/2011 Townsend ..... B05B 1/26 239/222.17
7,988,071 B2 * 8/2011 Bredberg ..... B05B 3/0454 239/203
8,006,919 B2 * 8/2011 Renquist ..... B05B 3/0422 239/240
8,028,932 B2 10/2011 Sesser
8,047,456 B2 11/2011 Kah
8,074,897 B2 12/2011 Hunnicutt
8,272,578 B1 9/2012 Clark
8,272,583 B2 * 9/2012 Hunnicutt ..... B05B 3/0486 239/582.1
8,282,022 B2 * 10/2012 Porter ..... B05B 3/0422 239/203
8,328,117 B2 12/2012 Bredberg
8,540,171 B2 9/2013 Renquist
8,567,691 B2 * 10/2013 Townsend ..... A01G 25/00 239/222.17
8,567,697 B2 10/2013 Bredberg
8,567,699 B2 * 10/2013 Sesser ..... B05B 3/003 239/222.11
8,602,325 B2 12/2013 Clark
8,672,242 B2 3/2014 Hunnicutt
8,695,900 B2 4/2014 Hunnicutt
8,783,582 B2 * 7/2014 Robertson ..... B05B 1/267 239/11
8,789,768 B2 7/2014 Hunnicutt
8,893,986 B2 11/2014 Kah, Jr.
8,925,837 B2 * 1/2015 Walker ..... B05B 1/304 239/224
8,991,724 B2 * 3/2015 Sesser ..... B05B 7/12 239/222.11
8,991,726 B2 3/2015 Kah, Jr.
8,991,730 B2 3/2015 Kah, Jr.
9,079,202 B2 * 7/2015 Walker ..... B05B 3/021
9,174,227 B2 * 11/2015 Robertson ..... B05B 3/08
9,248,459 B2 * 2/2016 Kah, Jr. ..... B05B 3/0418
9,295,998 B2 * 3/2016 Shadbolt ..... B05B 1/26
9,314,952 B2 4/2016 Walker
9,327,297 B2 * 5/2016 Walker ..... B05B 1/267
9,387,496 B2 * 7/2016 Kah, III ..... B05B 3/021
9,427,751 B2 * 8/2016 Kim ..... B05B 1/267
9,492,832 B2 11/2016 Kim
9,504,209 B2 * 11/2016 Kim ..... A01G 25/00
9,555,422 B2 * 1/2017 Zhao ..... B05B 1/08
9,757,743 B2 * 9/2017 Kah, Jr. ..... B05B 3/021
9,776,195 B2 * 10/2017 Russell ..... B05B 1/08
9,808,813 B1 11/2017 Porter
9,937,513 B2 4/2018 Kah, III
9,981,276 B2 5/2018 Kah, Jr.
9,987,639 B2 6/2018 Russell
10,092,913 B2 10/2018 Gopalan
10,201,818 B2 2/2019 Duffin
10,213,802 B2 * 2/2019 Kah, Jr. ..... B05B 3/0422
10,232,388 B2 3/2019 Glezerman
10,232,389 B1 3/2019 Forrest
10,239,067 B2 3/2019 Glezerman

(56) References Cited

U.S. PATENT DOCUMENTS

| | | | | |
|---|---|---|---|---|
| 10,322,422 | B2 | 6/2019 | Simmons | |
| 10,322,423 | B2 * | 6/2019 | Walker | B05B 3/003 |
| 2002/0139868 | A1 * | 10/2002 | Sesser | B05B 15/74 239/457 |
| 2003/0075620 | A1 * | 4/2003 | Kah, Jr. | B05B 1/262 239/553 |
| 2008/0054093 | A1 * | 3/2008 | Nelson | B05B 3/005 239/222.21 |
| 2008/0087743 | A1 * | 4/2008 | Govrin | B05B 15/40 239/214.13 |
| 2008/0257982 | A1 * | 10/2008 | Kah | B05B 1/265 239/222.11 |
| 2009/0078788 | A1 * | 3/2009 | Holmes | B05B 3/0486 239/222.17 |
| 2009/0108099 | A1 | 4/2009 | Porter | |
| 2010/0078508 | A1 | 4/2010 | South | |
| 2010/0090024 | A1 * | 4/2010 | Hunnicutt | B05B 3/0486 239/204 |
| 2010/0301135 | A1 * | 12/2010 | Hunnicutt | B05B 3/003 239/222.17 |
| 2011/0031325 | A1 * | 2/2011 | Perkins | B05B 3/0486 239/1 |
| 2011/0031332 | A1 * | 2/2011 | Sesser | B05B 3/005 239/222.17 |
| 2012/0273592 | A1 | 11/2012 | Zhang | |
| 2012/0292403 | A1 * | 11/2012 | Hunnicutt | B05B 3/003 239/222.17 |
| 2013/0105596 | A1 * | 5/2013 | Kah, III | B05B 3/02 239/222.13 |
| 2014/0042251 | A1 | 2/2014 | Maksymec | |
| 2014/0110501 | A1 * | 4/2014 | Lawyer | B05B 3/0486 239/222.17 |
| 2014/0224900 | A1 * | 8/2014 | Kim | B05B 3/003 239/222.17 |
| 2014/0263735 | A1 | 9/2014 | Nations | |
| 2014/0339334 | A1 * | 11/2014 | Kah, Jr. | B05B 3/0486 239/222.13 |
| 2015/0076253 | A1 | 3/2015 | Kah, Jr. | |
| 2015/0083828 | A1 | 3/2015 | Maksymec | |
| 2015/0158036 | A1 | 6/2015 | Kah, Jr. | |
| 2015/0165455 | A1 | 6/2015 | Kah | |
| 2015/0321207 | A1 * | 11/2015 | Kah, Jr. | B05B 3/021 239/231 |
| 2017/0056899 | A1 | 3/2017 | Kim | |
| 2017/0128963 | A1 | 5/2017 | Lin | |
| 2017/0203311 | A1 | 7/2017 | Kim | |
| 2017/0348709 | A1 * | 12/2017 | Kah, Jr. | B05B 3/0486 |
| 2018/0015487 | A1 | 1/2018 | Russell | |
| 2018/0058684 | A1 | 3/2018 | Qiu | |
| 2018/0141060 | A1 * | 5/2018 | Walker | B05B 3/005 |
| 2018/0221895 | A1 | 8/2018 | McCarty | |
| 2018/0250692 | A1 | 9/2018 | Kah, Jr. | |
| 2018/0257093 | A1 * | 9/2018 | Glezerman | B05B 3/021 |
| 2018/0280994 | A1 * | 10/2018 | Walker | B05B 1/304 |
| 2018/0311684 | A1 * | 11/2018 | Lawyer | B05B 3/008 |
| 2019/0015849 | A1 * | 1/2019 | Geerligs | B05B 3/021 |
| 2019/0054480 | A1 | 2/2019 | Sesser | |
| 2019/0054481 | A1 * | 2/2019 | Sesser | B05B 3/008 |
| 2019/0118195 | A1 | 4/2019 | Geerligs | |
| 2019/0133059 | A1 | 5/2019 | DeWitt | |
| 2019/0143361 | A1 | 5/2019 | Kah, Jr. | |
| 2019/0193095 | A1 | 6/2019 | Sesser | |

FOREIGN PATENT DOCUMENTS

| | | |
|---|---|---|
| GB | 908314 | 10/1962 |
| IL | 35182 | 4/1973 |

OTHER PUBLICATIONS

U.S. Appl. No. 15/649,072; Office Action dated Dec. 20, 2019 (pp. 1-15).

U.S. Appl. No. 16/219,595; Office Action dated Nov. 20, 2020 (pp. 1-8).

Images of deflector of K-Rain Rotary Nozzle RN200-ADJ, publicly available before Jan. 9, 2019.

U.S. Appl. No. 16/219,595; Office Action dated Mar. 15, 2021; (pp. 1-15).

* cited by examiner

ROTARY NOZZLES AND DEFLECTORS

FIELD

The invention relates to irrigation nozzles and, more particularly, to rotary nozzles using a rotating deflector.

BACKGROUND

Nozzles are commonly used for the irrigation of landscape and vegetation. In a typical irrigation system, various types of nozzles are used to distribute water over a desired area. One type of irrigation nozzle is the rotary nozzle (or rotating stream type) having a rotatable deflector with flutes for producing a plurality of relatively small water streams swept over a surrounding terrain area to irrigate adjacent vegetation.

Rotary nozzles of the type having a rotatable deflector with flutes for producing a plurality of relatively small outwardly projected water streams are known in the art. In such nozzles, water is directed upwardly against a rotatable deflector having a lower surface with curved flutes defining an array of relatively small flow channels extending upwardly and turning radially outwardly with a spiral component of direction. The water impinges upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range and trajectory of throw depending, in part, on the inclination and other geometry of the individual flutes.

In rotary nozzles, it is generally desirable to use nozzles with deflectors that provide relatively uniform water distribution to various areas of the irrigation coverage area. In some instances, it has been found that certain parts of the irrigation coverage area may not receive a sufficient amount of irrigation, such as areas close to the nozzle resulting in a doughnut-shaped (or annular) pattern. Further, for rotary nozzles that are intended to irrigate less than 360 degrees of coverage about the nozzle, it is also generally desirable to use nozzles with deflectors that provide a distinct and well-defined edge to the arcuate coverage area.

Accordingly, a need exists for a nozzle with a deflector that can provide relatively uniform water distribution about the nozzle. In addition, a need exists to increase the definition of the edges of an arcuate irrigation pattern. The nozzles and deflectors disclosed herein help address these needs.

DESCRIPTION OF THE PREFERRED EMBODIMENTS

Figure 1:
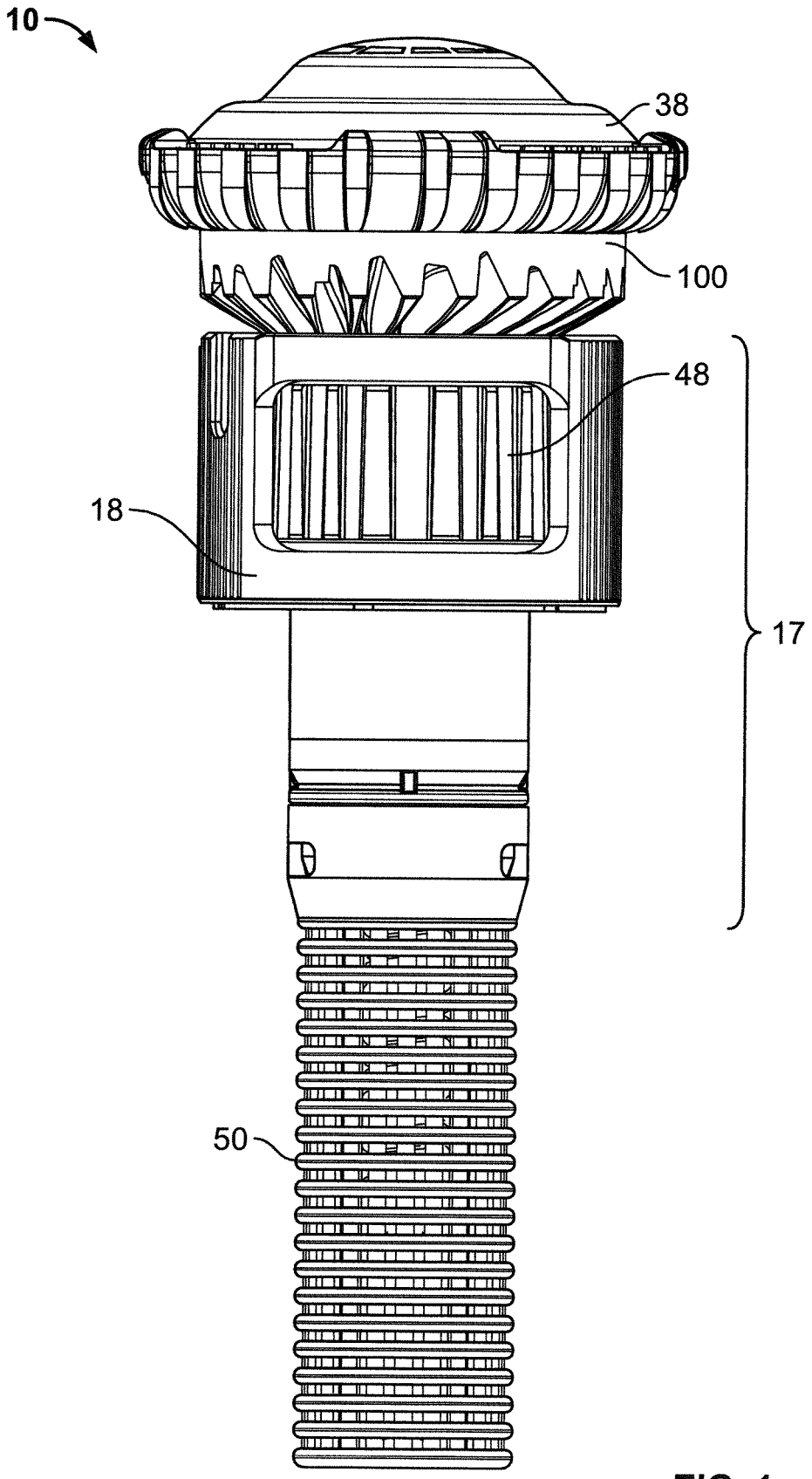
FIG. 1 is an elevation view of an embodiment of a nozzle embodying features of the present invention.

FIGS. 1-4B show an embodiment of a rotary nozzle 10 with a deflector 100 that embodies features of the present invention. The particular rotary nozzle 10 described herein produces 360 degrees of coverage, or full circle irrigation, about the nozzle 10. This particular nozzle 10 is disclosed herein, in part, for illustrative purposes to show the structural interaction of various nozzle components with each other and with the deflector 100 (or with an alternative deflector 200). It should be understood, however, that the deflectors 100, 200 described herein may be used with other types of rotary nozzles, such as, for example, rotary nozzles intended to provide irrigation to a defined arcuate coverage area about the nozzle (or rotary nozzles intended to provide irrigation to a rectangular (or strip) coverage area).

Some of the structural components of the nozzle 10 are similar to those described in U.S. Pat. Nos. 9,295,998 and 9,327,297, in U.S. Publication No. 2018/0141060, and in U.S. application Ser. No. 15/649,072. These patents and applications are assigned to the assignee of the present application and are incorporated herein by reference in their entirety. Differences are addressed below and can be seen with reference to the figures.

As described in more detail below, in this particular example of a rotary nozzle, the nozzle 10 includes a rotating deflector 100 and two bodies (a valve sleeve 16 and nozzle housing 18) that together define an annular exit orifice 15 (or annular discharge gap) therebetween to produce full circle irrigation. The deflector 100 is supported for rotation by a shaft 20, which itself does not rotate. Indeed, in certain preferred forms, the shaft 20 may be fixed against rotation, such as through use of splined engagement surface 72.

Figure 2:
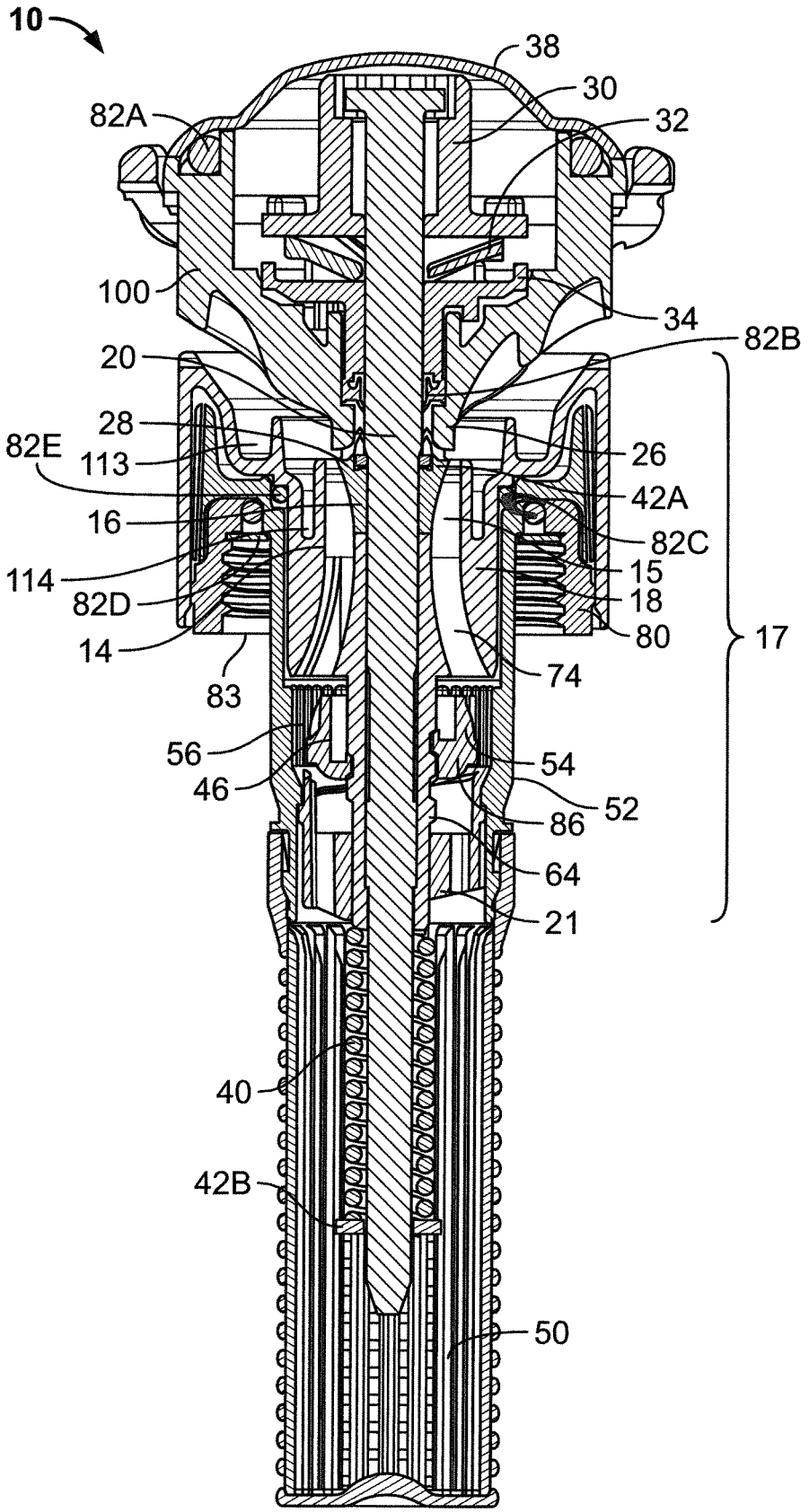
FIG. 2 is a cross-sectional view of the nozzle of FIG. 1.

As can be seen in FIGS. 1-4B, the nozzle 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 17. As can be seen in FIGS. 1 and 2, the nozzle body 17 generally refers to the sub-assembly of components disposed between the filter 50 and the deflector 100. The water preferably passes through an inlet 21 controlled by a radius adjustment feature that regulates the amount of fluid flow through the nozzle body 17. Water is then directed generally upwardly through flow passages in the nozzle housing 18 and through the annular exit orifice 15 (defining an outlet to the nozzle body 17) to produce upwardly directed water jets that impinge the underside surface of the deflector 100 for rotatably driving the deflector 100.

Figure 4A:
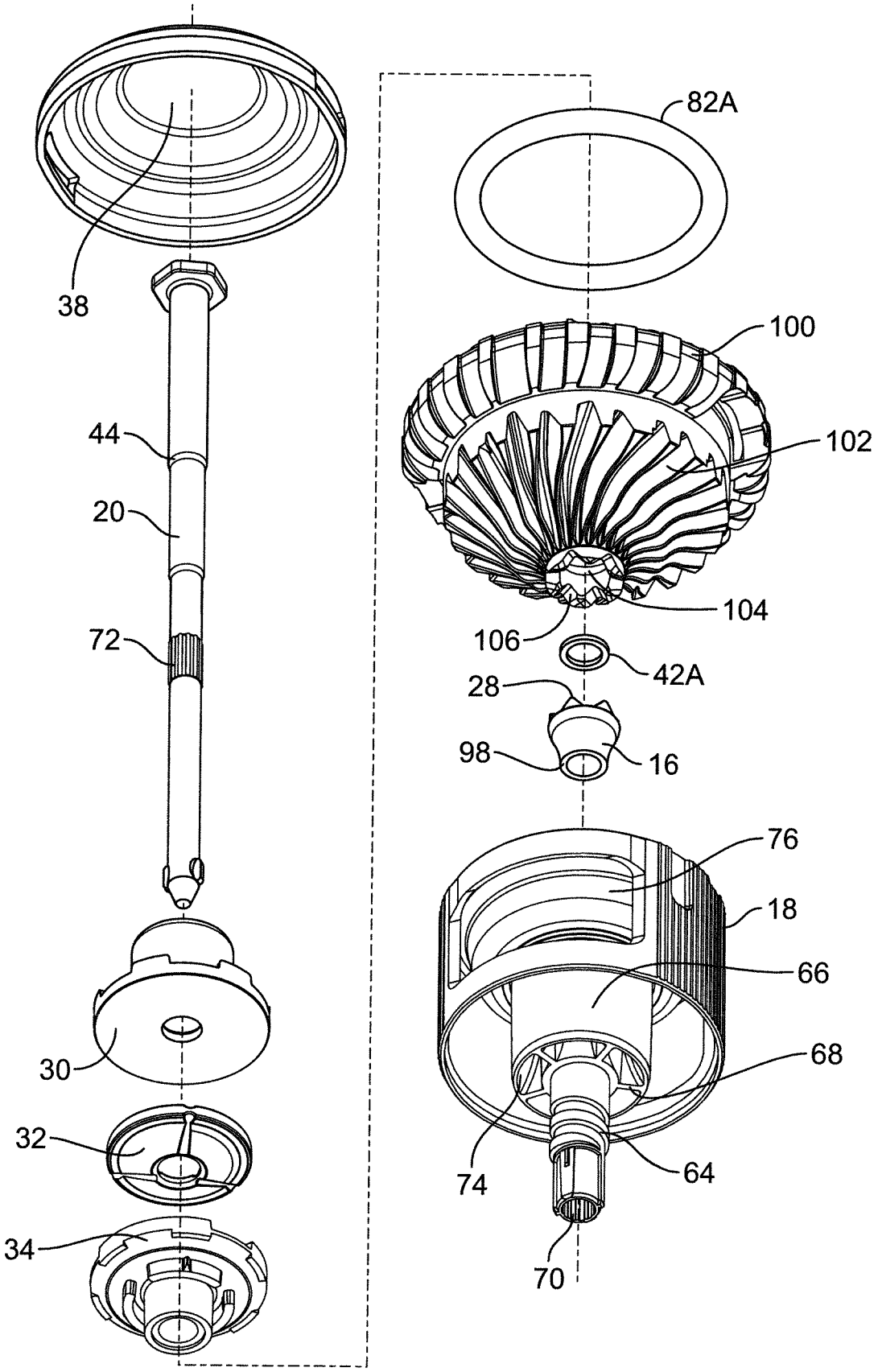
FIGS. 4A and 4B are bottom exploded perspective views of the nozzle of FIG. 1.

The rotatable deflector 100 has an underside surface that is preferably contoured to deliver a plurality of fluid streams generally radially outwardly. As shown in FIG. 4A, the underside surface of the deflector 100 includes an array of flutes 102. The flutes 102 subdivide the water into the plurality of relatively small water streams which are distributed radially outwardly to surrounding terrain as the deflector 100 rotates. The flutes 102 define a plurality of intervening flow channels extending upwardly and outwardly along the underside surface with various selected inclination angles. During operation of the nozzle 10, the upwardly directed water impinges upon the lower or upstream segments of these flutes 102, which subdivide the water flow into the plurality of relatively small flow streams for passage through the flow channels and radially outward projection from the nozzle 10.

The deflector 100 has a bore 104 for insertion of a shaft 20 therethrough. As can be seen in FIG. 4A, the bore 104 is preferably defined at its lower end by circumferentially-arranged, downwardly-protruding teeth 106. As described further below, these teeth 106 are sized to engage corresponding teeth 28 on the valve sleeve 16. In some forms, this engagement allows a user to depress the deflector 100, so that the deflector teeth 106 and valve sleeve teeth 28 engage, and then rotate to clear out debris from the annular exit orifice 15 and/or to rotate the entire nozzle 10 to conveniently install the nozzle 10 on a retracted riser stem.

The deflector 100 also preferably includes a speed control brake to control the rotational speed of the deflector 100. In one preferred form shown in FIGS. 2, 3A, and 4A, the speed control brake includes a friction disk 30, a brake pad 32, and a seal retainer 34. The friction disk 30 preferably has an internal surface (or socket) for engagement with a top surface (or head) on the shaft 20 so as to fix the friction disk 30 against rotation. The seal retainer 34 is preferably welded to, and rotatable with, the deflector 100 and, during operation of the nozzle 10, is urged against the brake pad 32, which, in turn, is retained against the friction disk 30. Water is directed upwardly and strikes the deflector 100, pushing the deflector 100 and seal retainer 34 upwards and causing rotation. In turn, the rotating seal retainer 34 engages the brake pad 32, resulting in frictional resistance that serves to reduce, or brake, the rotational speed of the deflector 100. Speed brakes like the type shown in U.S. Pat. No. 9,079,202 and U.S. Publication No. 2018/0141060, which are assigned to the assignee of the present application and are incorporated herein by reference in their entirety, are preferably used. Although the speed control brake is shown and preferably used in connection with nozzle 10 described and claimed herein, other brakes or speed reducing mechanisms are available and may be used to control the rotational speed of the deflector 100.

The deflector 100 is supported for rotation by shaft 20. Shaft 20 extends along a central axis of the nozzle 10, and the deflector 100 is rotatably mounted on an upper end of the shaft 20. As can be seen from FIGS. 2 and 4A, the shaft 20 extends through the bore 104 in the deflector 100 and through aligned bores in the friction disk 30, brake pad 32, and seal retainer 34, respectively. A cap 38 and o-ring, 82A are mounted to the top of the deflector 100. The cap 38, in conjunction with the o-ring, 82A, prevent grit and other debris from coming into contact with the components in the interior of the deflector sub-assembly, such as the speed control brake components, and thereby hindering the operation of the nozzle 10.

The deflector 100, in conjunction with the seal retainer 34, brake pad 32 and friction disk 30, can be extended or pulled in an upward direction while the nozzle 10 is energized and distributing fluid. This upward movement displaces the valve sleeve 16 from the nozzle housing 18 in a vertical direction to temporarily increase the size of the annular discharge gap 15, and thus, allow for the clearance of trapped debris within the nozzle's internal passageways. This "pull to flush" feature allows for the flushing of trapped debris out in the direction of the fluid flow.

A spring 40 mounted to the shaft 20 energizes and tightens the engagement of the valve sleeve 16 and the nozzle housing 18. More specifically, the spring 40 operates on the shaft 20 to bias the first of the two nozzle body portions (valve sleeve 16) downwardly against the second portion (nozzle housing 18). Mounting the spring 40 at one end of the shaft 20 results in a lower cost of assembly. As can be seen in FIG. 2, the spring 40 is mounted near the lower end of the shaft 20 and downwardly biases the shaft 20. In turn, the shaft shoulder 44 exerts a downward force on the washer/retaining ring 42A and valve sleeve 16 for pressed fit engagement with the nozzle housing 18.

As shown in FIG. 2, the nozzle 10 also preferably includes a radius control valve 46 (or radius adjustment valve). The radius control valve 46 can be used to adjust the fluid flowing through the nozzle 10 for purposes of regulating the range of throw of the projected water streams. It is adapted for variable setting through use of a rotatable segment 48 (FIG. 1) located on an outer wall portion of the nozzle 10. It functions as a valve that can be opened or closed to allow the flow of water through the nozzle 10. Also, a filter 50 is preferably located upstream of the radius control valve 46, so that it obstructs passage of sizable particulate and other debris that could otherwise damage the nozzle components or compromise desired efficacy of the nozzle 10.

As shown in FIGS. 2-4B, the radius control valve structure preferably includes a nozzle collar 52 and a flow control member 54. The nozzle collar 52 is rotatable about the central axis of the nozzle 10. It has an internal engagement surface 56 and engages the flow control member 54 so that rotation of the nozzle collar 52 results in rotation of the flow control member 54. The flow control member 54 also engages the nozzle housing 18 such that rotation of the flow control member 54 causes the member 54 to also move in an axial direction, as described further below. In this manner, rotation of the nozzle collar 52 can be used to move the flow control member 54 helically in an axial direction closer to and further away from the inlet 21. When the flow control member 54 is moved closer to the inlet 21, the throw radius is reduced. The axial movement of the flow control member 54 towards the inlet 21 increasingly constricts the flow through the inlet 21 just downstream of the inlet 21. When the flow control member 54 is moved further away from the inlet 21, the throw radius is increased until the maximum radius position is achieved. This axial movement allows the user to adjust the effective throw radius of the nozzle 10 without disruption of the streams dispersed by the deflector 100. A clutching mechanism, including radial tabs 62, preferably prevents excessive torque application or over-travel of the flow control member 54 when the flow control member 54 is in its most distant position, or maximum radius setting, from the inlet 21.

As shown in FIGS. 2-4B, the nozzle collar 52 is preferably cylindrical in shape and includes an engagement surface 56, preferably a splined surface, on the interior of the cylinder. The nozzle collar 52 preferably also includes an outer wall 58 having an external grooved surface for gripping and rotation by a user. Water flowing through the inlet 21 passes through the interior of the cylinder and through the remainder of the nozzle body 17 to the deflector 100. Rotation of the outer wall 58 causes rotation of the entire nozzle collar 52.

Figure 3A:
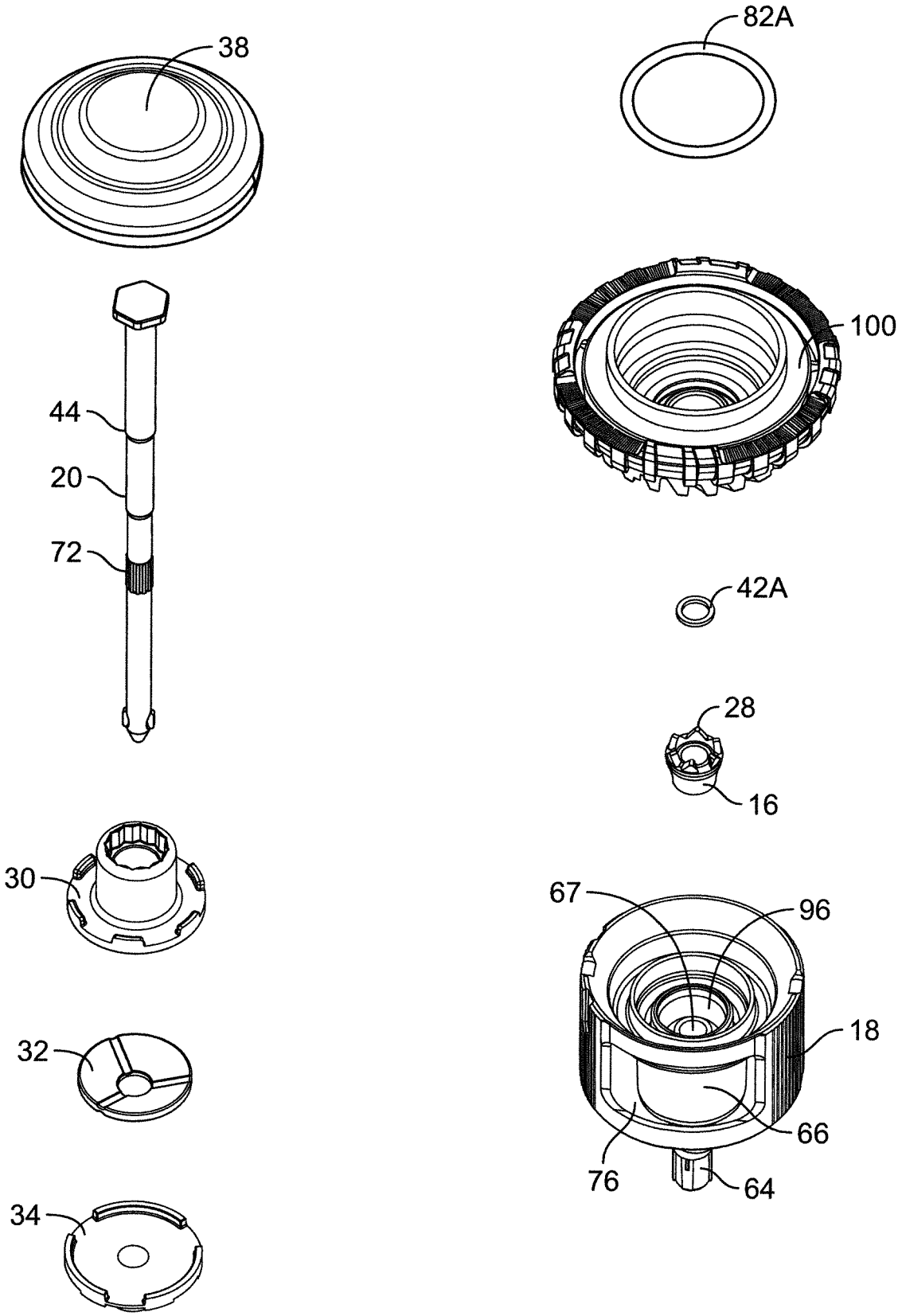
FIGS. 3A and 3B are top exploded perspective views of the nozzle of FIG. 1.
Figure 3B:
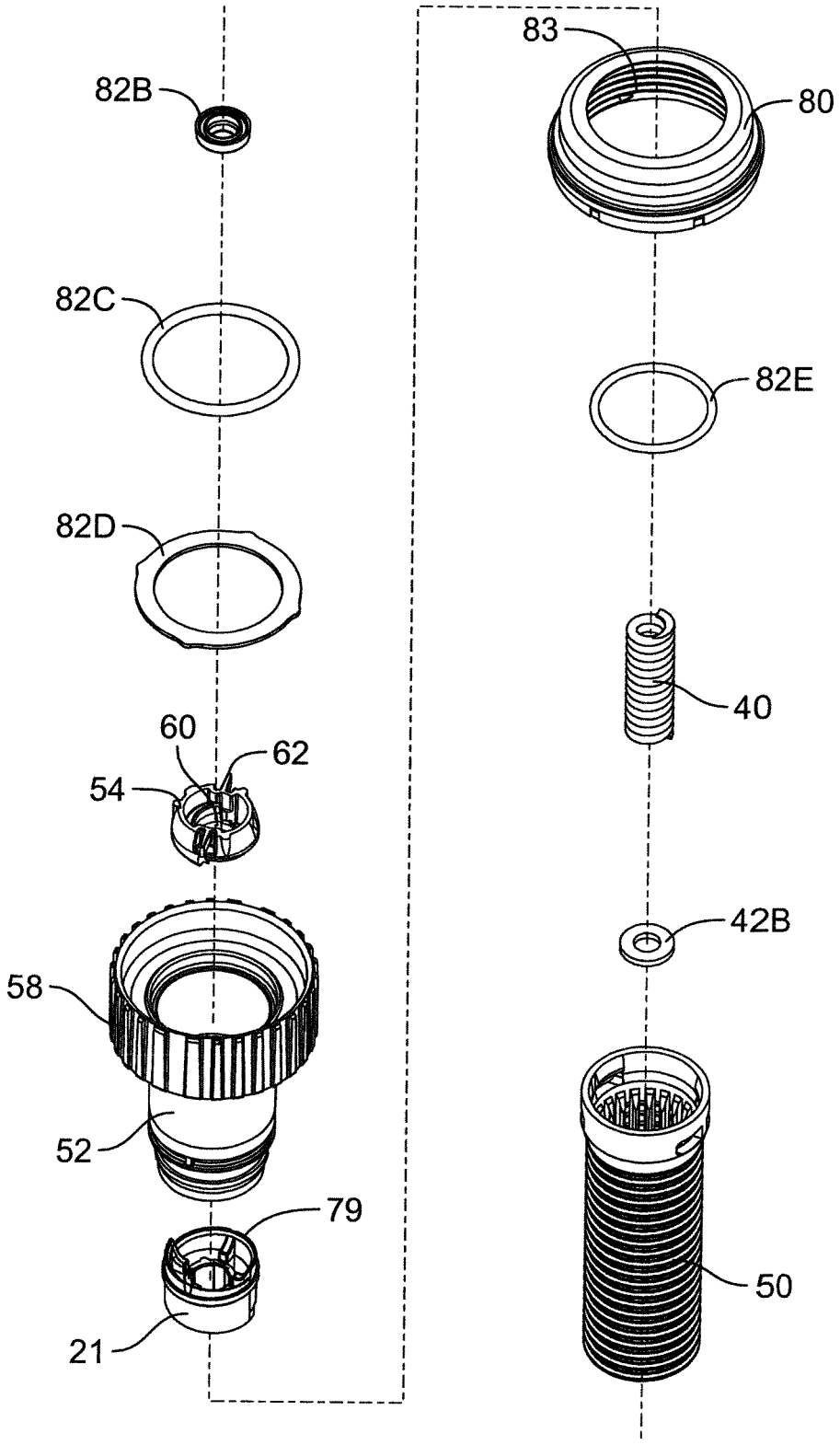
Figure 4B:
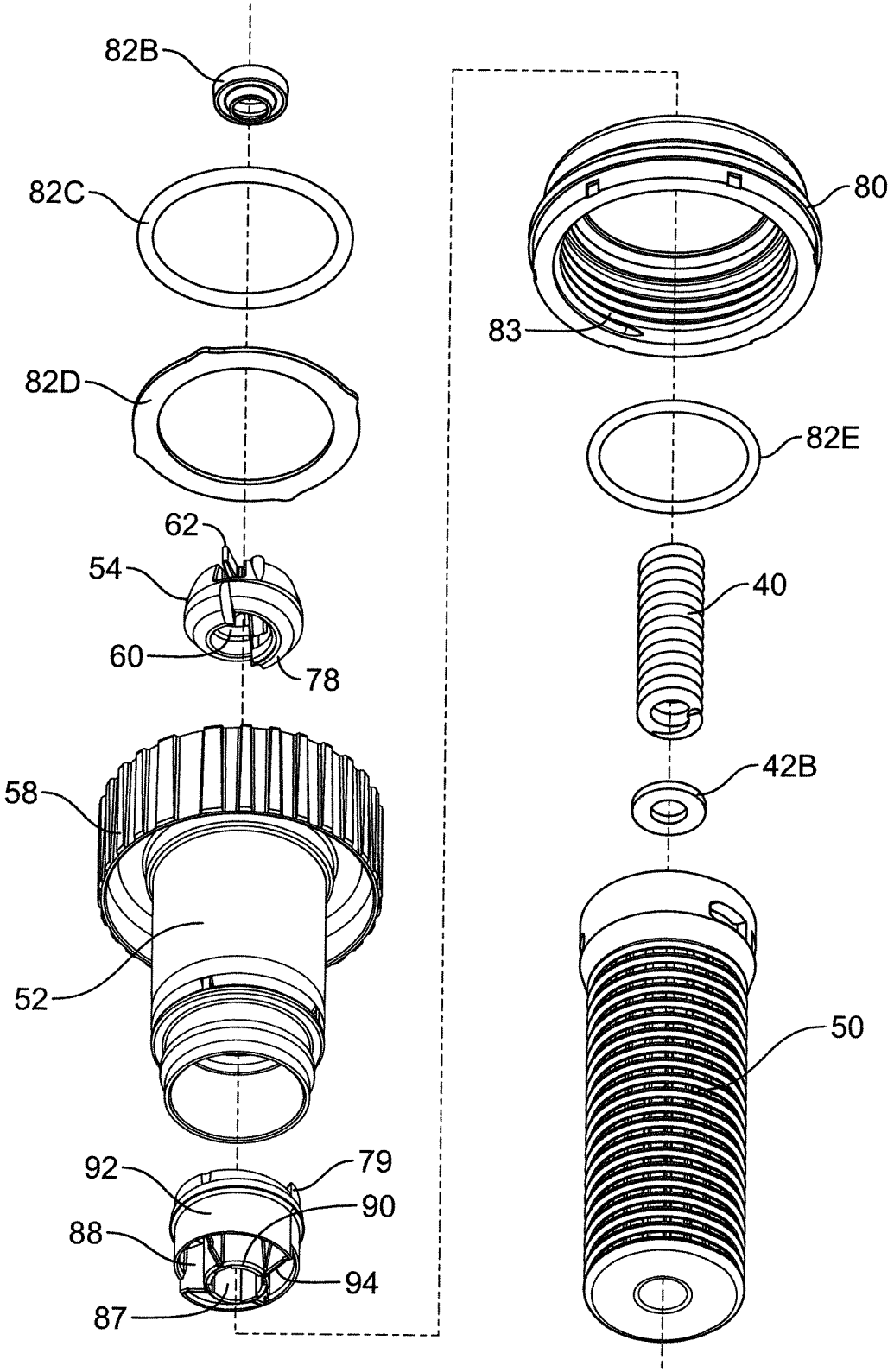

The nozzle collar 52 is coupled to the flow control member 54 (or throttle body). As shown in FIGS. 3B and 4B, the flow control member 54 is preferably in the form of a ring-shaped nut with a central hub defining a central bore 60. The flow control member 54 has an external surface with two thin tabs 62 extending radially outward for engagement with the corresponding internal splined surface 56 of the nozzle collar 52. The tabs 62 and internal splined surface 56 interlock such that rotation of the nozzle collar 52 causes rotation of the flow control member 54 about the central axis. In addition, these tabs 62 of the flow control member 54 act as a clutching mechanism that prevents over-travel and excessive application of torque, as well as providing a tactile and audible feedback to the user when the flow control member 54 reaches its respective limits of travel.

In turn, the flow control member 54 is coupled to the nozzle housing 18. More specifically, the flow control member 54 is internally threaded for engagement with an externally threaded hollow post 64 at the lower end of the nozzle housing 18. Rotation of the flow control member 54 causes it to move along the threading in an axial direction. In one preferred form, rotation of the flow control member 54 in a counterclockwise direction advances the member 54 towards the inlet 21 and away from the deflector 100. Conversely, rotation of the flow control member 54 in a clockwise direction causes the member 54 to move away from the inlet 21. Although specified here as counterclockwise for advancement toward the inlet 21 and clockwise for movement away from the inlet 21, this is not required, and either rotation direction could be assigned to the advancement and retreat of the flow control member 54 from the inlet 21. Finally, although threaded surfaces are shown in the preferred embodiment, it is contemplated that other engagement surfaces could be used to achieve an axial movement of the flow control member 54.

The nozzle housing 18 preferably includes an inner cylindrical wall 66 joined by spoke-like ribs 68 to a central hub 70. The central hub 70 preferably defines the bore 67 to accommodate insertion of the shaft 20 therein. The inside of the central hub 70 is preferably splined to engage a splined surface 72 of the shaft 20 and fix the shaft 20 against rotation. The lower end forms the external threaded hollow post 64 for insertion in the bore 60 of the flow control member 54, as discussed above. The spokes 68 define flow passages 74 to allow fluid flow upwardly through the remainder of the nozzle 10.

In operation, a user may rotate the outer wall 58 of the nozzle collar 52 in a clockwise or counterclockwise direction. As shown in FIGS. 3A and 4A, the nozzle housing 18 preferably includes one or more cut-out portions 76 to define one or more access windows to allow rotation of the nozzle collar outer wall 58. Further, as shown in FIG. 2, the nozzle collar 52, flow control member 54, and nozzle housing 18 are oriented and spaced to allow the flow control member 54 to essentially limit fluid flow through the nozzle 10 or to allow a desired amount of fluid flow through the nozzle 10. The flow control member 54 preferably has a radiused helical bottom surface 78 for engagement with a matching notched helical surface 79 on the inlet member. This matching helical surface 79 acts as a valve seat but with a segmented 360 degree pattern to allow a minimum flow when the matching helical surfaces 78 and 79 are fully engaged. The inlet 21 can be a separate insert component that snap fits and locks into the bottom of the nozzle collar 52. The inlet 21 also includes a bore 87 to receive the hollow post 64 of the nozzle housing 18. The bore 87 and the post 64 include complementary gripping surfaces (FIGS. 4A and 4B) so that the inlet 21 is locked against rotation.

Rotation in a counterclockwise direction results in helical movement of the flow control member 54 in an axial direction toward the inlet 21. Continued rotation results in the flow control member 54 advancing to the valve seat formed at the inlet 21 for restricting or significantly reducing fluid flow. The dimensions of the radial tabs 62 of the flow control member 54 and the splined internal surface 56 of the nozzle collar 52 are preferably selected to provide over-rotation protection. More specifically, the radial tabs 62 are sufficiently flexible such that they slip out of the splined recesses upon over-rotation, i.e., clutching. Once the limit of the travel of the flow control member 54 has been reached, further rotation of the nozzle collar 52 causes clutching of the radial tabs 62, allowing the collar 52 to continue to rotate without corresponding rotation of the flow control member 54, which might otherwise cause potential damage to the nozzle components.

Rotation in a clockwise direction causes the flow control member 54 to move axially away from the inlet 21. Continued rotation allows an increasing amount of fluid flow through the inlet 21, and the nozzle collar 52 may be rotated to the desired amount of fluid flow. It should be evident that the direction of rotation of the outer wall 58 for axial movement of the flow control member 54 can be easily reversed, i.e., from clockwise to counterclockwise or vice versa. When the valve is open, fluid flows through the nozzle 10 along the following flow path: through the inlet 21, between the nozzle collar 52 and the flow control member 54, through the passages 74 of the nozzle housing 18, through the constriction formed at the valve sleeve 16, to the underside surface of the deflector 100, and radially outwardly from the deflector 100.

The nozzle 10 also preferably includes a nozzle base 80 of generally cylindrical shape with internal threading 83 for quick and easy thread-on mounting onto a threaded upper end of a riser with complementary threading (not shown). The nozzle base 80 and nozzle housing 18 are preferably attached to one another by welding, snap-fit, or other fastening method such that the nozzle housing 18 is stationary relative to the base 80 when the base 80 is threadedly mounted to a riser. The nozzle 10 also preferably include seal members, such as seal members 82A, 82B, 82C, 82D, and 82E, at various positions, such as shown in FIGS. 2-4B, to reduce leakage. The nozzle 10 also preferably includes retaining rings or washers, such as retaining rings/washers 42A and 42B, disposed, for example, at the top of valve sleeve 16 (preferably for engagement with shaft shoulder 44) and near the bottom end of the shaft 20 for retaining the spring 40.

The radius adjustment valve 46 and certain other components described herein are preferably similar to that described in U.S. Pat. Nos. 8,272,583 and 8,925,837, which are assigned to the assignee of the present application and are incorporated herein by reference in their entirety. Generally, in this preferred form, the user rotates a nozzle collar 52 to cause the flow control member 54 (which may be in the form of a throttle nut) to move axially toward and away from the valve seat at the inlet 21 to adjust the throw radius. Although this type of radius adjustment valve 46 is described herein, it is contemplated that other types of radius adjustment valves may also be used.

The nozzle 10 described above uses a valve sleeve 16 and a nozzle housing 18 to define an annular exit orifice for full circle irrigation. As an alternative, however, the nozzle 10 may use a valve sleeve 16A and nozzle housing 18A (shown in FIGS. 5A and 5B) to define an adjustable arcuate opening and an adjustable arc of irrigation coverage. In this arcuate form, the nozzle 10 allows a user to depress and rotate the deflector 100 to directly actuate an arc adjustment valve, i.e., to open and close the valve. The user depresses the deflector 100 to directly engage and rotate one of the two nozzle body portions that forms the valve (valve sleeve 16A) via the engagement of the deflector teeth and the valve sleeve teeth. The valve preferably operates through the use of two helical engagement surfaces 19, 23 on the valve sleeve 16A and nozzle housing 18A, respectively, that cam against one another to define an arcuate opening.

Figure 5A:
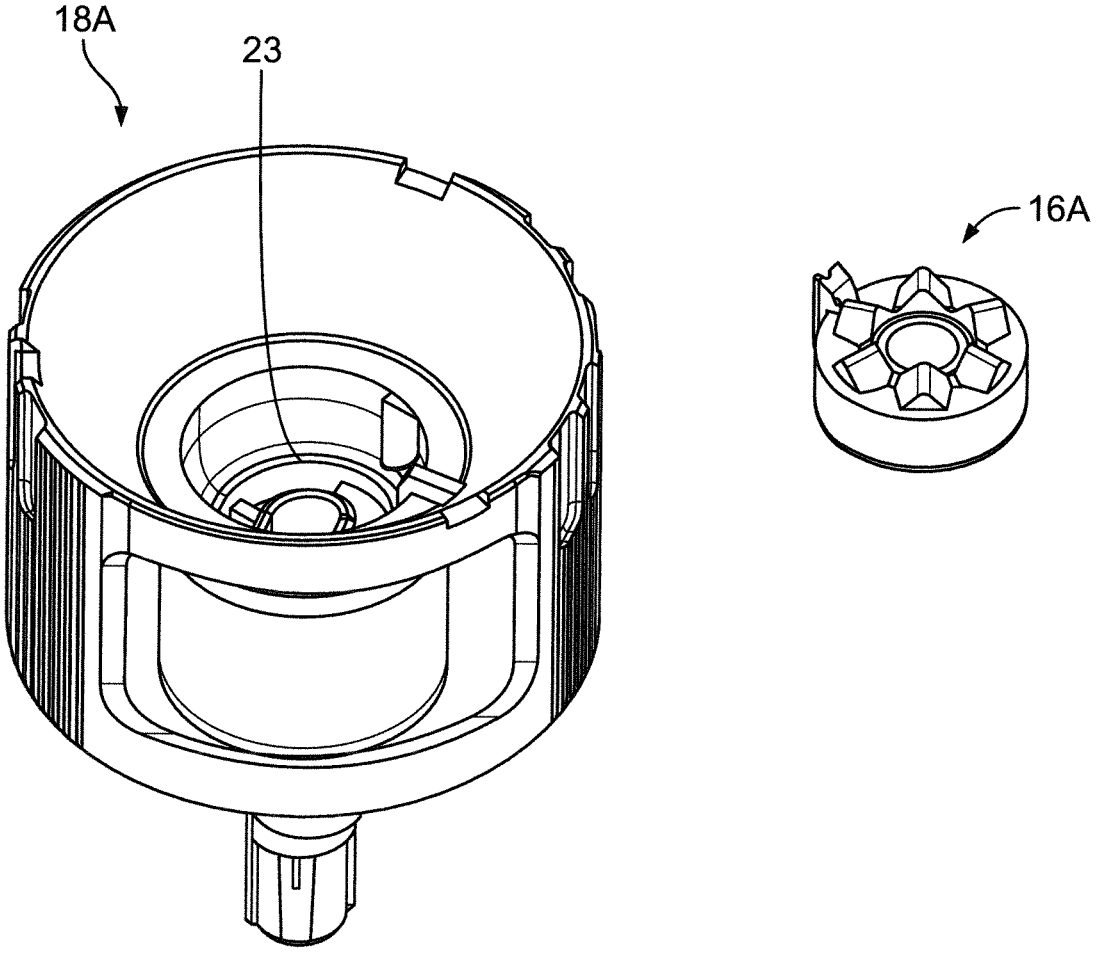
FIGS. 5A and 5B are top and bottom perspective views showing alternative valve bodies for the nozzle of FIG. 1.
Figure 5B:
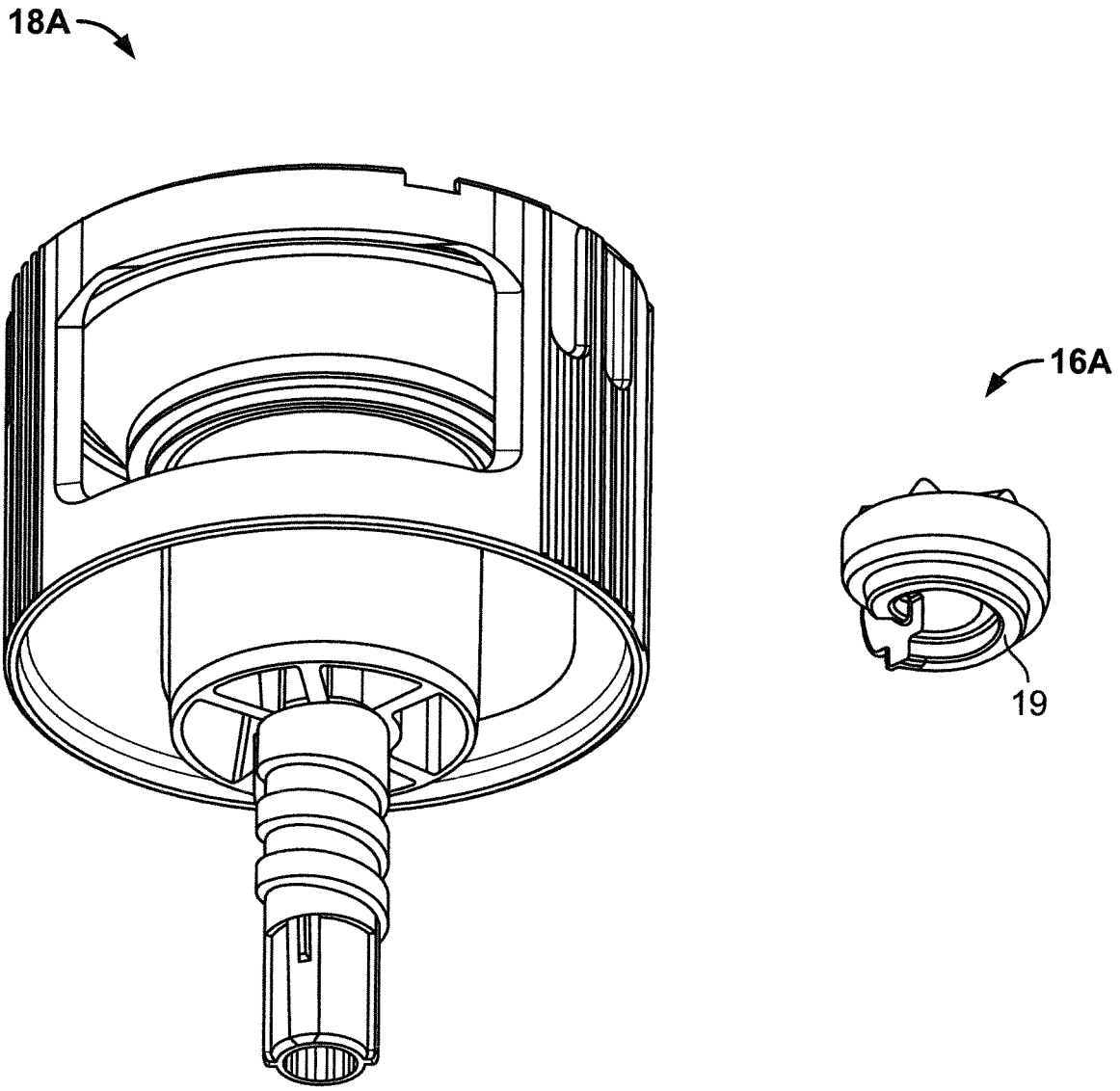

In this particular form, the variable arc capability of nozzle 10 results from the interaction of two portions of the nozzle body 17 (valve sleeve 16A and nozzle housing 18A). More specifically, as can be seen in FIGS. 5A and 5B, the valve sleeve 16A and nozzle housing 18A have corresponding helical engagement surfaces. The valve sleeve 16A may be rotatably adjusted with respect to the nozzle housing 18A to close the arc adjustment valve, i.e., to adjust the length of arcuate opening, and this rotatable adjustment also results in upward or downward translation of the valve sleeve 16A. The arcuate opening may be adjusted to a desired water distribution arc by the user through push down and rotation of the deflector 100. The arc adjustment valve and components described herein are preferably similar to that described in U.S. Pat. Nos. 8,272,583 and 8,925,837, which are assigned to the assignee of the present application and are incorporated herein by reference in their entirety.

The disclosure above generally describes some components of an exemplary rotary nozzle 10 using a deflector 100 embodying features of the present invention. This description has been provided, in part, for illustrative purposes to provide a general understanding of certain types of nozzle components and their interaction with the deflector 100. It should be understood, however, that the deflector 100 may be used with any of various different types of rotary nozzles where a rotating deflector 100 is used, and those other rotary nozzles may or may not include the some or all of the nozzle components described above.

As described further below, deflector 100 provides certain advantages. More specifically, it is believed that certain structural features at the ends of the flutes 102 can provide certain irrigation coverage advantages. Initially, it is believed that uniformity of water distribution over an irrigation pattern can be improved. Features at the ends of the flutes 102 can break up the outgoing streams, thereby diverting part of the streams and creating more spray that helps fill in the irrigation coverage area near the nozzle.

Figure 6:
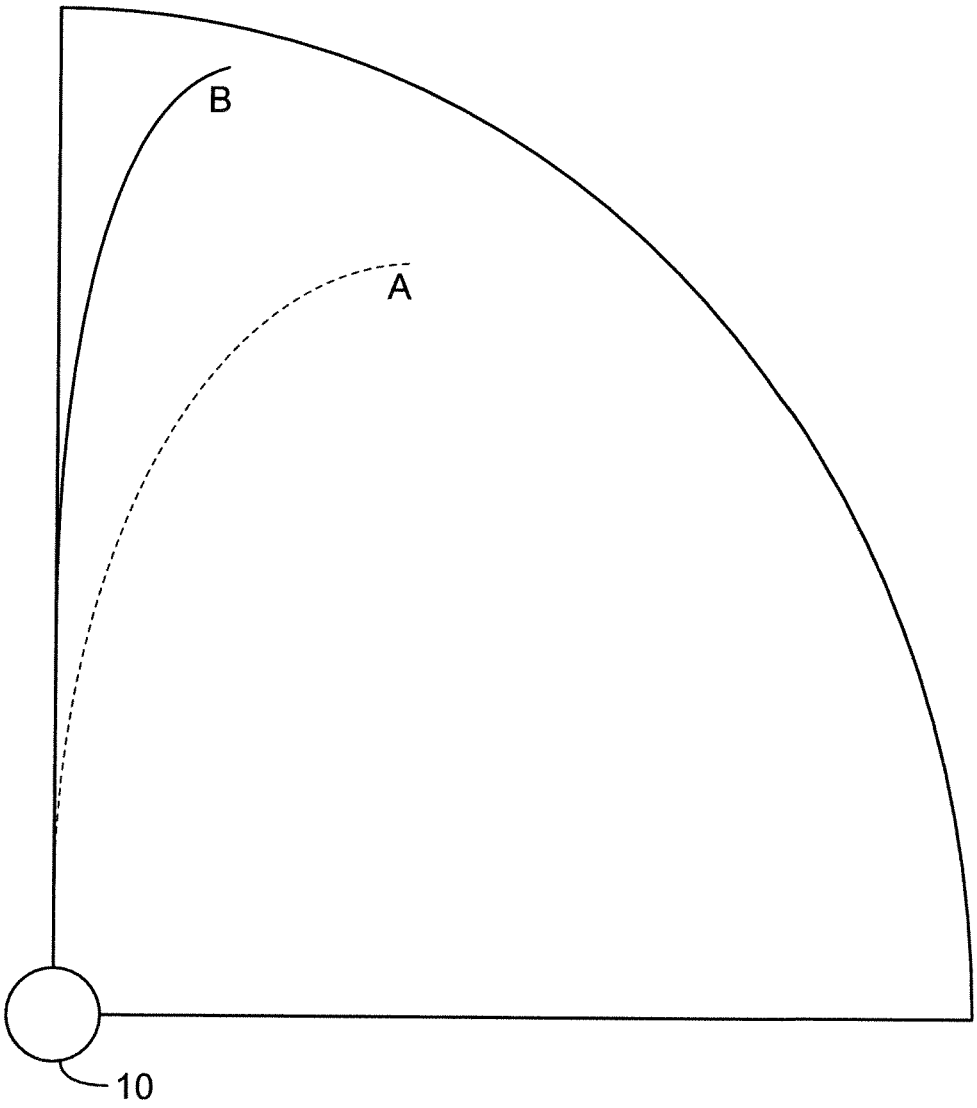
FIG. 6 is a schematic view of a 90° arcuate coverage pattern.

In addition, this deflector 100 may provide an advantage for rotary nozzles distributing water to an arcuate region less than 360° about the nozzle, especially at the one or both edges of the arcuate coverage pattern. More specifically, as shown in FIG. 6, conventional deflectors may produce a pronounced curved edge to an arcuate coverage area. For example, for a 90° arcuate pattern, the dashed line A in FIG. 6 shows a curved left pattern edge that may be produced by some conventional deflectors rotating in a clockwise direction. Further, it is believed that deflector flutes that are only partially filled contribute to heavy precipitation near the nozzle, especially for low trajectory flutes. In contrast, as shown by the solid line B, it is believed that a deflector 100 with certain end-of-flute features can help produce a straighter left edge to the arcuate pattern and more uniform precipitation along this edge. The deflector 100 with certain end-of-flute features produces a pattern that is the result of a more dynamic distribution of water.

Figure 7:
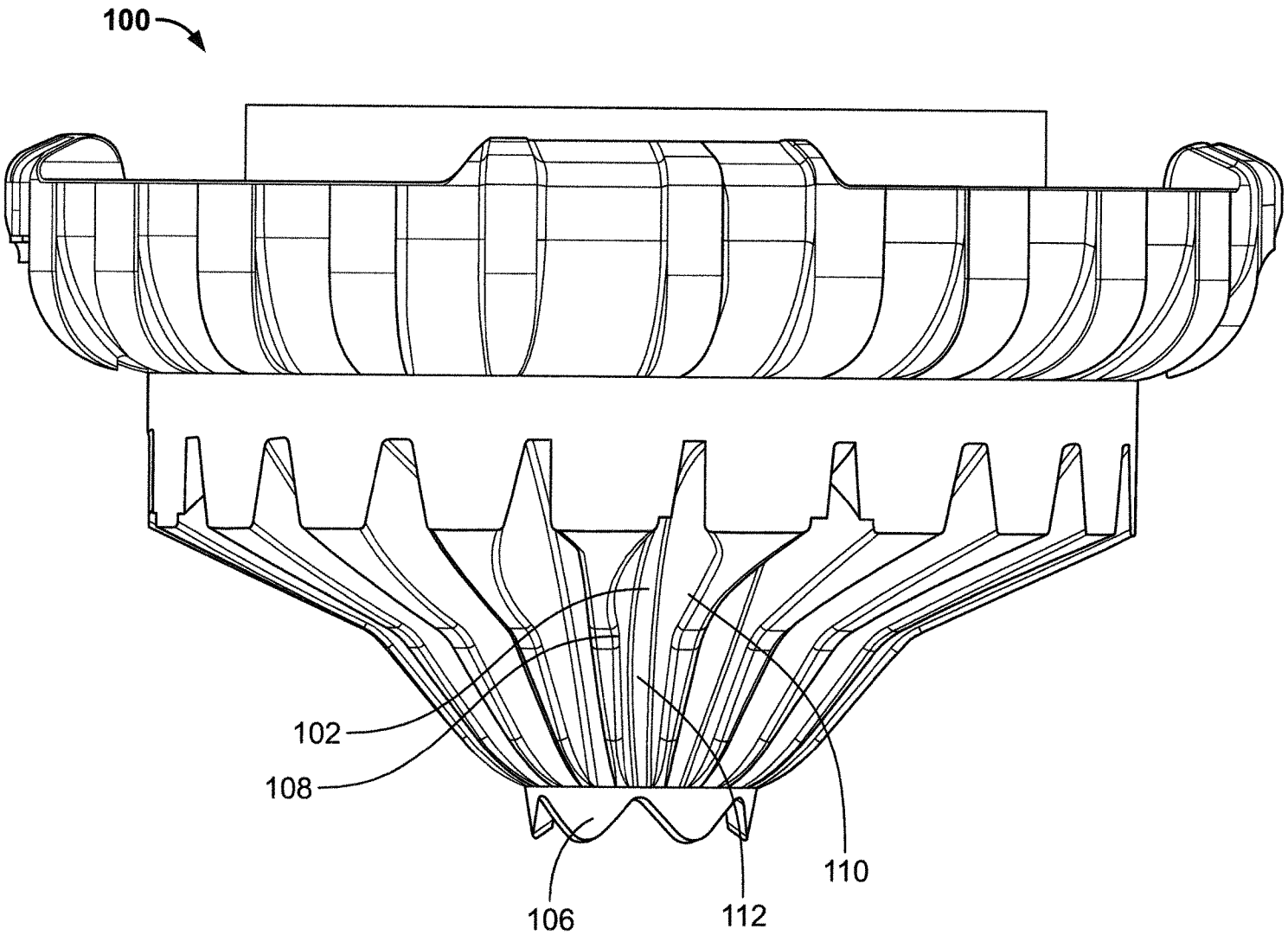
FIG. 7 is an elevational view of a first embodiment of a deflector that may be used with the nozzle of FIG. 1.
Figure 8:
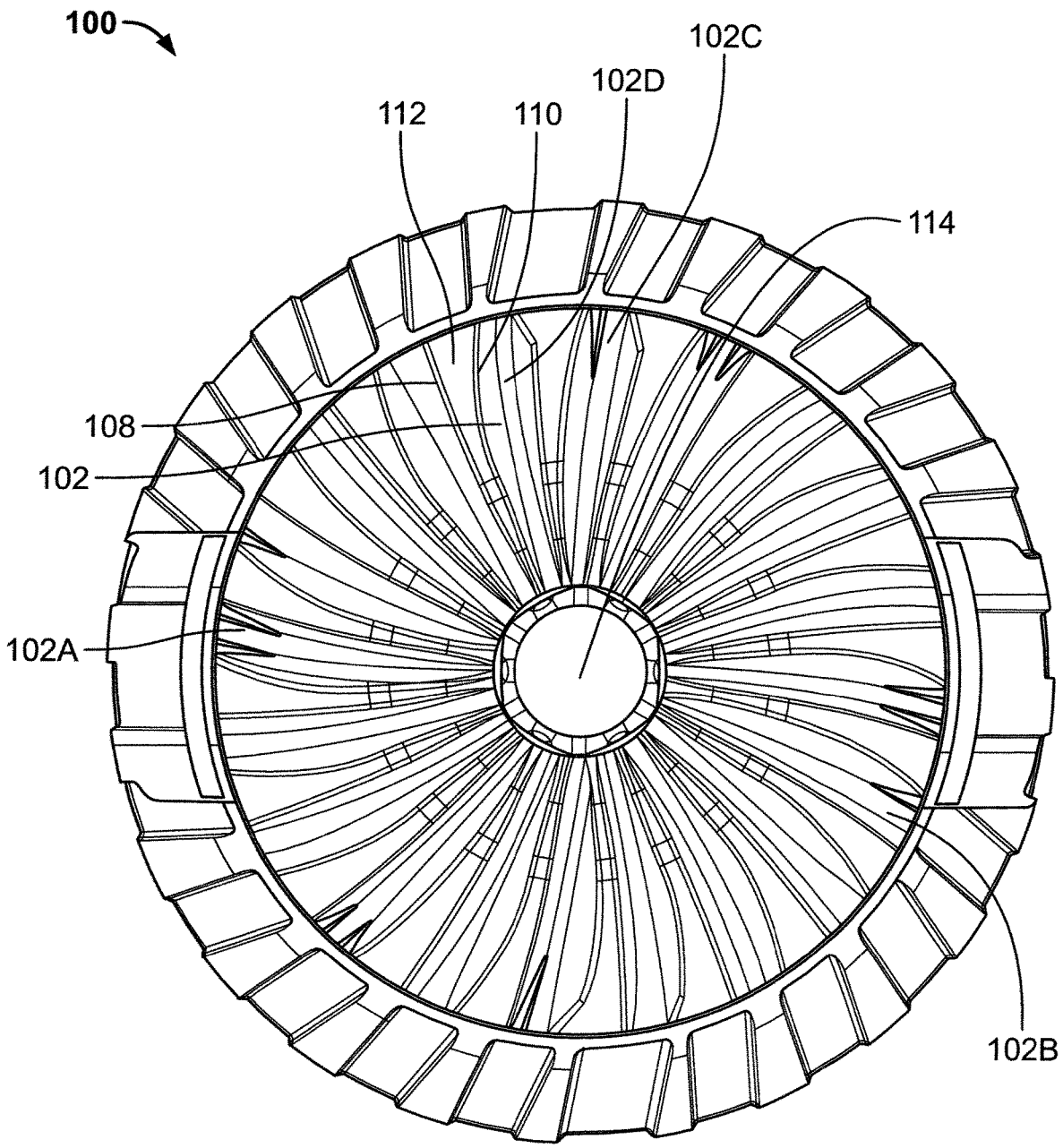
FIG. 8 is a bottom view of the deflector of FIG. 7.

FIGS. 7 and 8 show side elevation and bottom views of deflector 100. Each flute 102 generally includes a first sidewall 108 and a second sidewall 110 defining a channel 112 therebetween. As can be seen from FIG. 8, the flutes 102 each define the same general shape in the xy-plane, and if extended inwardly, they will each intersect with and terminate at or about the central axis 114 of the deflector 100. In other words, these flutes 102 have a uniform curvilinear shape in the xy-plane. It has been found generally that these flutes 102 require a certain amount of curvature so as to drive the rotation of the deflector 100. In addition, in the deflector 100, the flutes 102 are arranged to distribute water streams at different trajectories to attempt to provide uniform coverage of the irrigation pattern.

Figure 9:
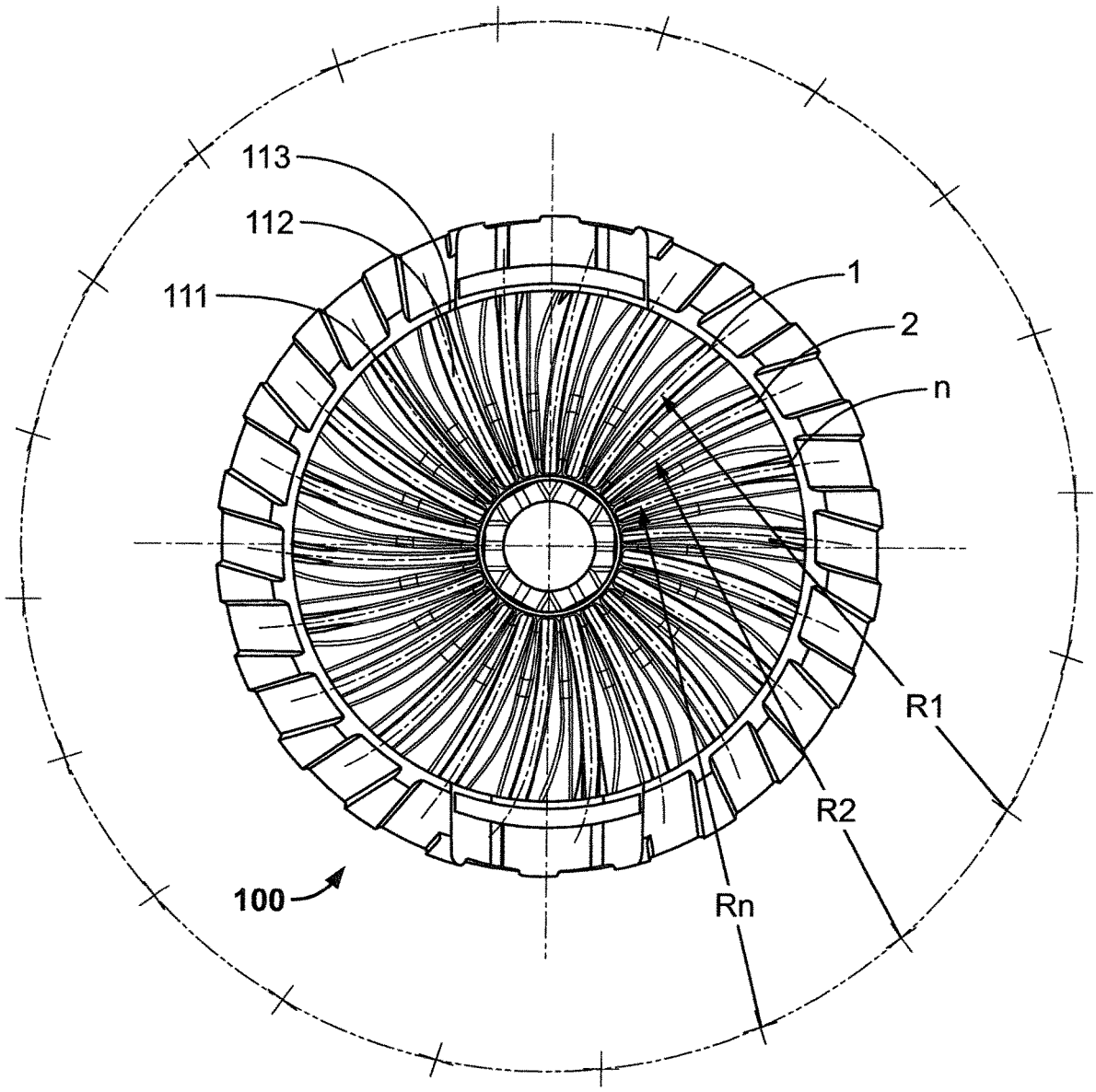
FIG. 9 is a schematic representation of the deflector of FIG. 7.

FIG. 9 shows a simplified representation of the basic flute geometry of the deflector 100 in the xy-plane, disregarding the inclination of the flutes 102 in the z-plane defining, in part, the elevation and trajectories of the exiting water streams. In the xy-plane, each of the flutes 102 defines a channel 112 with a linear inner portion and a curved outer portion, and each channel 112 extends from an inner end 111 to an outlet end 113. FIG. 9 has been annotated to show the curvature of the channels 112 relative to a center line through the channels 112. The curvature is the same for all flutes 102, and the curved outer portion of each flute 102 has the same radius of curvature. In this example, the deflector 100 shown includes 20 flutes, and flutes 1, 2, and n are marked for reference. Each of these flutes has its radius of curvature indicated by R1, R2, and Rn, and these radiuses of curvatures are the same. For instance, each flute (n) has the same radius of curvature (Rn) of 1.075", and the remaining flutes have the same radius of curvature. This deflector 100 may be used to produce full circle irrigation about a nozzle with a maximum throw radius of 18'. These values for the number of flutes 102 and the uniform radius of curvature are just non-limiting examples, and it is generally contemplated that the deflector 100 may be designed with different numbers of flutes and with a different uniform radius of curvature so as to accommodate different throw radiuses.

The deflector 100 also includes features at the end of the flutes 102 that are intended to fill in the irrigation pattern more uniformly. They generally act as blocking features and/or downwardly-directed features that absorb some of the energy of the exiting water streams. These end-of-flute features form transitions with the sidewalls 108, 110 of the flutes 102, and these transitions define elongated edges and corners that form abrupt changes in direction. In effect, they operate to divert some of the water stream from each flute 102 to an area closer to the nozzle.

Figure 10:
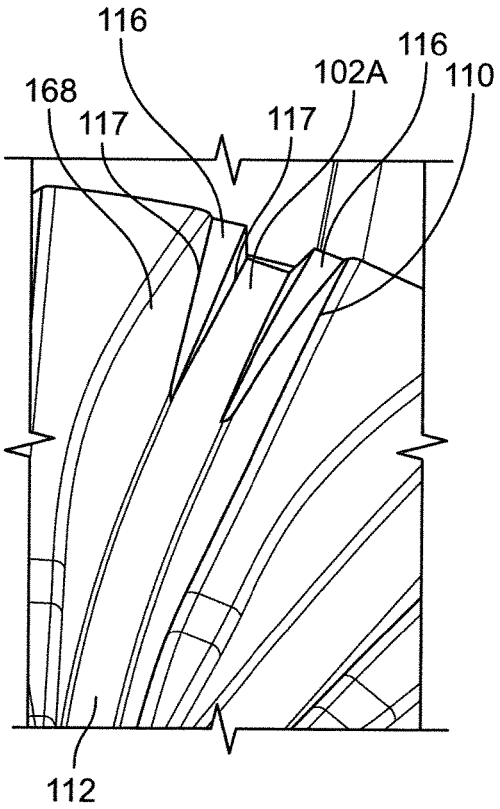
FIGS. 10, 11, 12, and 13 are enlarged partial views of a portion of the flutes of the deflector of FIG. 7 showing end-of-flute features.
Figure 11:
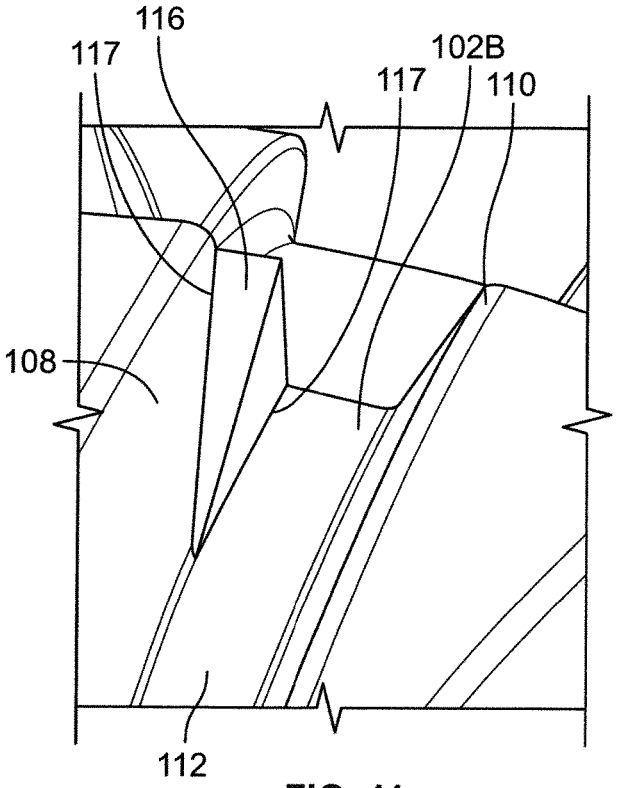

FIGS. 10 and 11 show the ends of certain flutes 102 with downwardly-directed ramps or wedges 116 disposed adjacent one or both sidewalls 108, 110 of the flutes. More specifically, FIG. 10 shows downwardly-directed ramps 116 at both sides of the end of flute 102A ("symmetric ramps"), while FIG. 11 shows a downwardly-directed ramp 116 at one side of the end of flute 102B ("asymmetric ramps"). As can be seen in FIG. 8, in this particular form, there are four flutes 102A with two symmetric ramps 116 (one adjacent each sidewall 108, 110), and there are two flutes 102B with an asymmetric ramp 116 adjacent one sidewall (and with no feature at the other sidewall). As can be seen, these ramps 116 form sharp and immediate transitions 117 defining edges and corners with respect to the channels 112 and the sidewalls 108, 110. An immediate transition refers generally to a sharp change of direction, rather than a gradual change of direction such as might arise from a curved wall. In one preferred form, the ramps 116 may have lengths ranging from about 0.061 to 0.086 inches, a maximum width of about 0.010 or 0.011 inches, heights ranging from about 0.021 to 0.050 inches, and angles of inclination ranging from about 24 to 44 degrees. Further, in one preferred form, with respect to flute 102A shown in FIG. 10, the channel 112 may narrow to a gap ranging from about 0.016 to 0.029 inches at the flute exit between the symmetric ramps 116. These dimensional ranges are illustrative examples, and other dimensions may be desirable.

As should be understood, FIG. 8 shows one non-limiting example of the disposition and arrangement of the flutes 102A, 102B with symmetric and asymmetric ramps 116, but other numbers and arrangements of such ramps 116 may be desirable to fill in the irrigation pattern. Different numbers and arrangements of such ramps 116 may produce different results for different patterns, such as, for example, full circle patterns, arcuate patterns that are less than full circle, and strip patterns.

Figure 12:
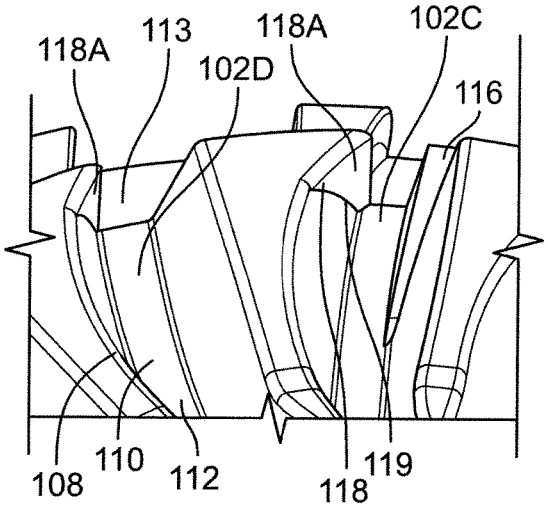
Figure 13:
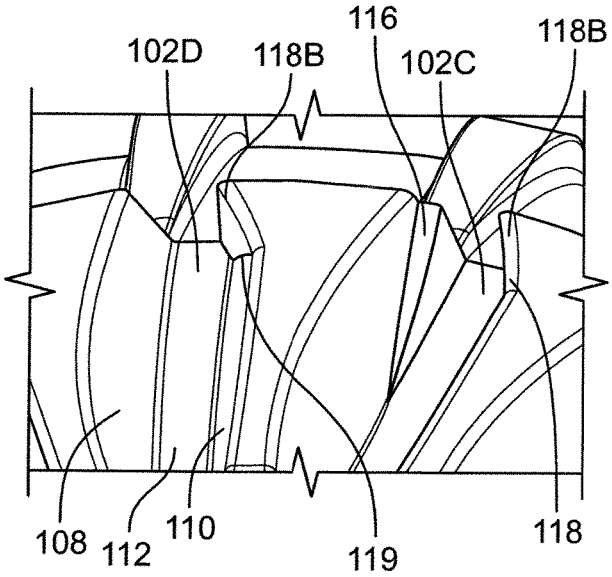

FIGS. 12 and 13 show the outlet ends 113 of certain flutes 102 with sharply angled walls 118 that act, in part, as blocking features. These angled walls 118 are not coextensive with the sidewalls 108, 110 and instead form abrupt and immediate transitions 119 therewith. These abrupt transitions 119 define edges and corners, preferably with angles ranging from about 25 to 28 degrees between the side wall 108, 110 and the angled wall 118. This range is another illustrative example, and other ranges may be desirable. As indicated, it is believed that the angled walls 118 have a damming effect that transforms at least part of the exiting water streams into a fan that increases water distributed close to the nozzle. As can be seen from FIGS. 8, 12, and 13, there are two flutes 102C that include both an angled wall 118 at one side of the flute 102C and an asymmetric ramp 116 at the other side, and there are two flutes 102D that include only an angled wall 118 at one side of the flute 102D (and with no ramp 116 at the other side).

It is generally contemplated that the deflector 100 may be designed to include any of various combinations of ramps 116 (symmetric and asymmetric) and angled walls 118. FIG. 8 shows one possible combination of such ramps 116 and angled walls 118, but it should be understood that many other combinations are possible, as desired, to address the specific irrigation needs of a rotary nozzle and coverage area. It is generally contemplated, however, that at least one of the plurality of flutes 102 of the deflector 100 includes an angled wall 118 at the outlet end 113 of its channel 112 with the angled wall 118 defining a transition 119 with one of the first and second sidewalls 108, 110 of the flute 102 such that the angled wall 118 is not coextensive with that sidewall 108, 110. Other forms of the deflector 100 may or may not include additional angled walls 118 at other flutes 102 and may or may not include ramps 116 at some of the flutes 102.

Further, in the particular form shown in FIGS. 8, 12, and 13, there are two pairs of flutes 102 with walls 118 that are angled in different directions. The first pair of flutes 102 are adjacent one another and include walls 118A that are angled more sharply in the direction of curvature of the channel 112. The second pair of flutes 102 are also adjacent one another and are generally disposed on the opposite side of the deflector 100 from the first pair of flutes 102. This second pair of flutes 102 have walls 118B that are angled in the opposite direction from the direction of curvature of the channel 112. In this particular form, it is believed that the combination of flutes 102 with angled walls 118 oriented in opposite directions is useful in filling in the pattern.

As stated, deflector 100 shows one non-limiting example, and different numbers and arrangements of angled walls 118 on the deflector 100 are available and may be desirable to fill in the irrigation pattern. As one example, it may be desirable to have only two flutes 102 with opposite-facing angled walls 118. Further, the orientation of the angled walls 118 may be selected, as desired. For instance, one wall 118 may be angled in the direction of curvature of its channel 112, while the second wall 118 may be angled in the opposite direction against the curvature of the channel 112. In addition, the location of the angled walls 118 on the deflector 100 may be selected, as desired. For example, two flutes 102 with opposite facing angled walls 118 may be disposed on opposite sides of the deflector 100 from one another. Different numbers, arrangements, and locations of such angled walls 118 may produce different results that may be desirable for different types of patterns.

Figure 18:
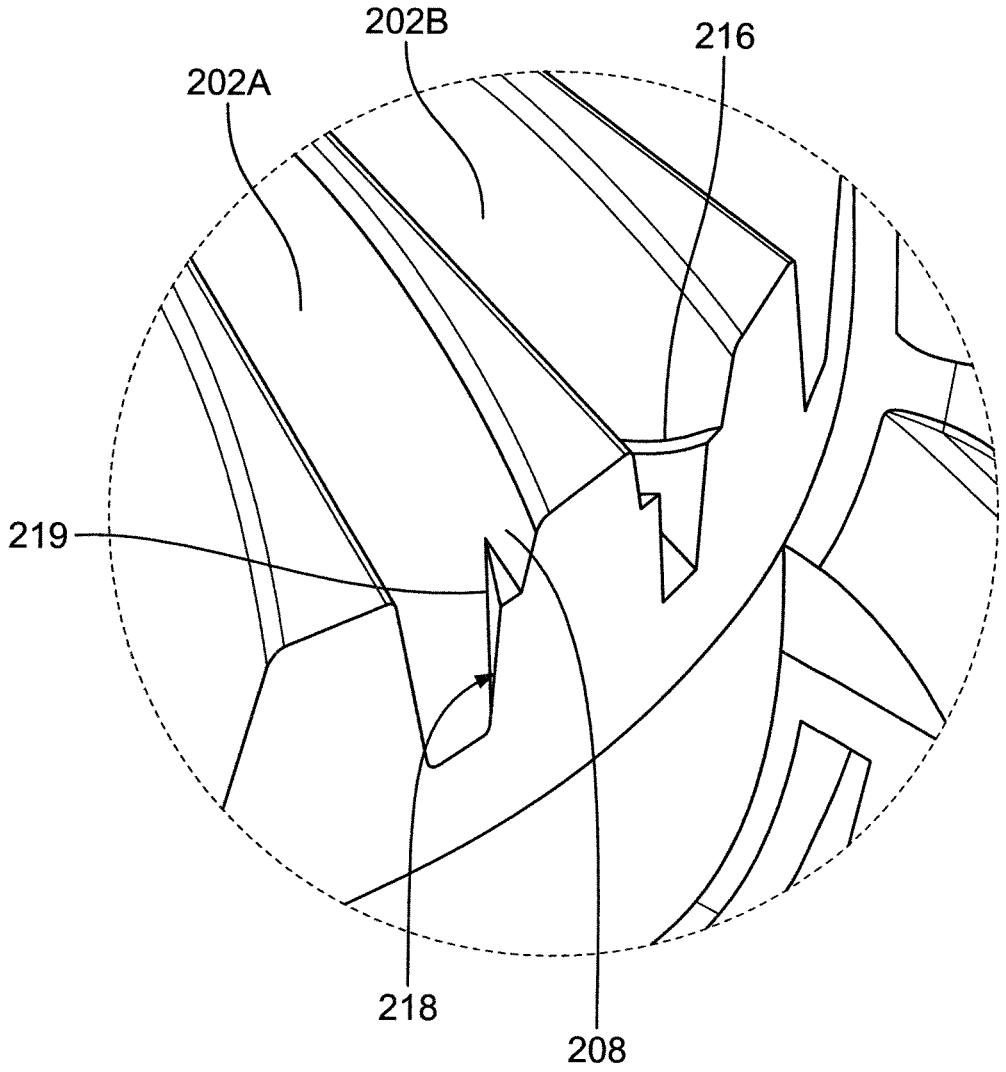
FIG. 18 is an enlarged partial view of a portion of the flutes of the deflector of FIG. 14 showing end-of-flute features.

In addition, as shown in FIG. 18, it is contemplated that some or all of the angled walls 118 need not extend the entire height at the exit of the flute 102. Instead, the angled wall 118 may extend to only a partial height at the flute exit, such as, for example, to a height of about 75% at one side of a flute exit. The remainder of the wall is then not angled at all but is instead coextensive with the sidewall 108, 110.

As stated above, it is believed that the angled walls 118 help fill in irrigation patterns. It is also believed that the walls 118 angled in the direction of curvature provide an additional advantage. More specifically, for nozzles that produce an arcuate pattern less than a full circle pattern, it is believed that these walls 118 help provide a straighter (less curved) edge at one or both edges of the pattern. For a deflector 100 with flute curvature as shown in the figures (that rotate in a clockwise direction with respect to FIG. 6), it is believed that the walls 118 provide a straighter edge at the left edge of the pattern. Further, the walls 118 angled in the opposite direction, i.e., opposite the curvature of the channel 112, may help provide a straighter edge at the other edge of the pattern (the right edge).

As stated, it is generally contemplated that the deflector 100 having at least one flute 102 with an angled wall 118 may also include any of various combinations of flutes 102 with ramps 116. In other words, it is generally contemplated that the deflector 100 may include any of various numbers and combinations of flutes 102, such as, for example, various numbers and combinations of flutes 102A, 102B, 102C, and 102D. In addition, it is generally contemplated that these flutes 102 may be disposed at various locations on the deflector 100 with respect to one another.

Referring to FIGS. 14-18, there is shown an alternative deflector 200 with multiple flutes 202 that may be used with rotary nozzle 10 and with other rotary nozzles (especially rotary nozzles that produce an arcuate pattern). As addressed further below, this deflector 200 includes one flute 202A with an angled wall 218 that is of a partial height and eight flutes 202B that have symmetric ramps 216 (which correspond generally to the symmetric ramps 116 shown in FIG. 10). It is believed the flutes 202B with the symmetric ramps 216 provide some break up of the exiting water streams but not to an excessive degree that might otherwise cause the streams to appear distorted, non-uniform, and aesthetically displeasing. Further, it is believed that the symmetry of the ramps 216 in the flutes 202B helps facilitate a uniform and consistent speed of rotation of the deflector 200.

Figure 14:
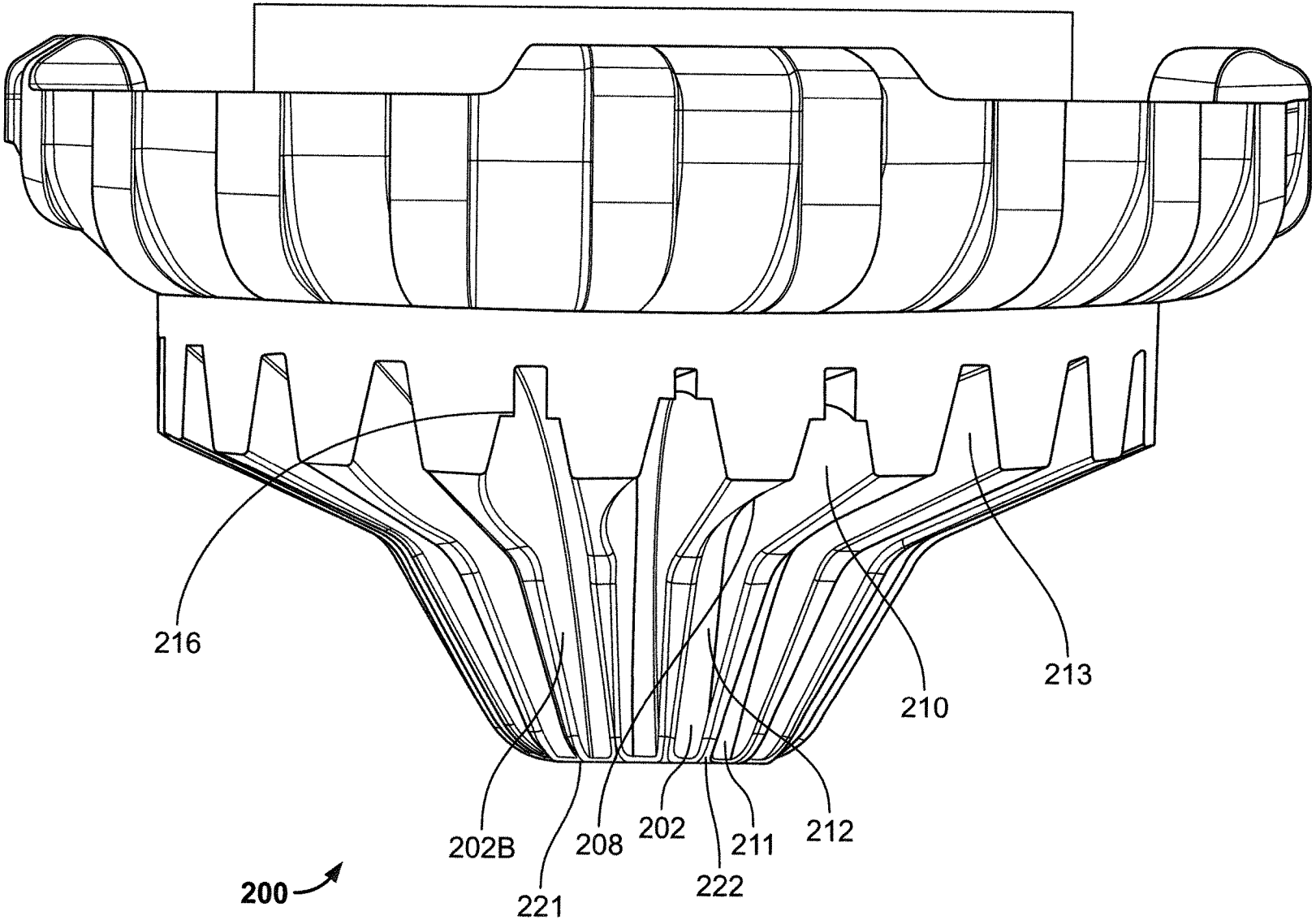
FIG. 14 is an elevational view of a second embodiment of a deflector that may be used with the nozzle of FIG. 1.
Figure 15:
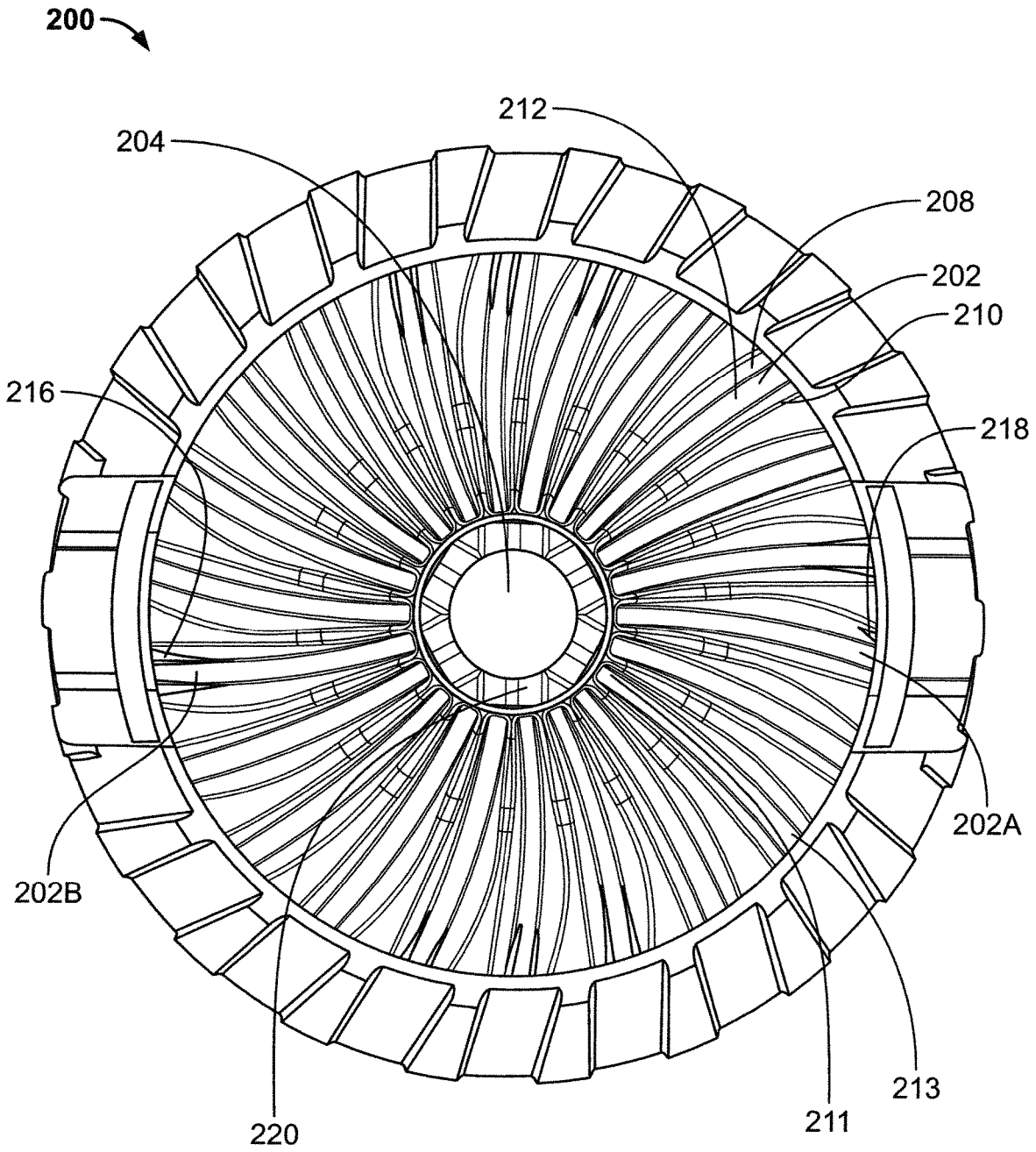
FIG. 15 is a bottom view of the deflector of FIG. 14.

FIGS. 14 and 15 show side and bottom views of deflector 200. Each flute 202 generally includes a first sidewall 208 and a second sidewall 210 defining a channel 212 therebetween. Like flutes 102 of deflector 100, the flutes 202 each define the same general shape in the xy-plane and have a uniform curvilinear shape in the xy-plane. In addition, the flutes 202 are arranged to distribute water streams at different trajectories.

Figure 16:
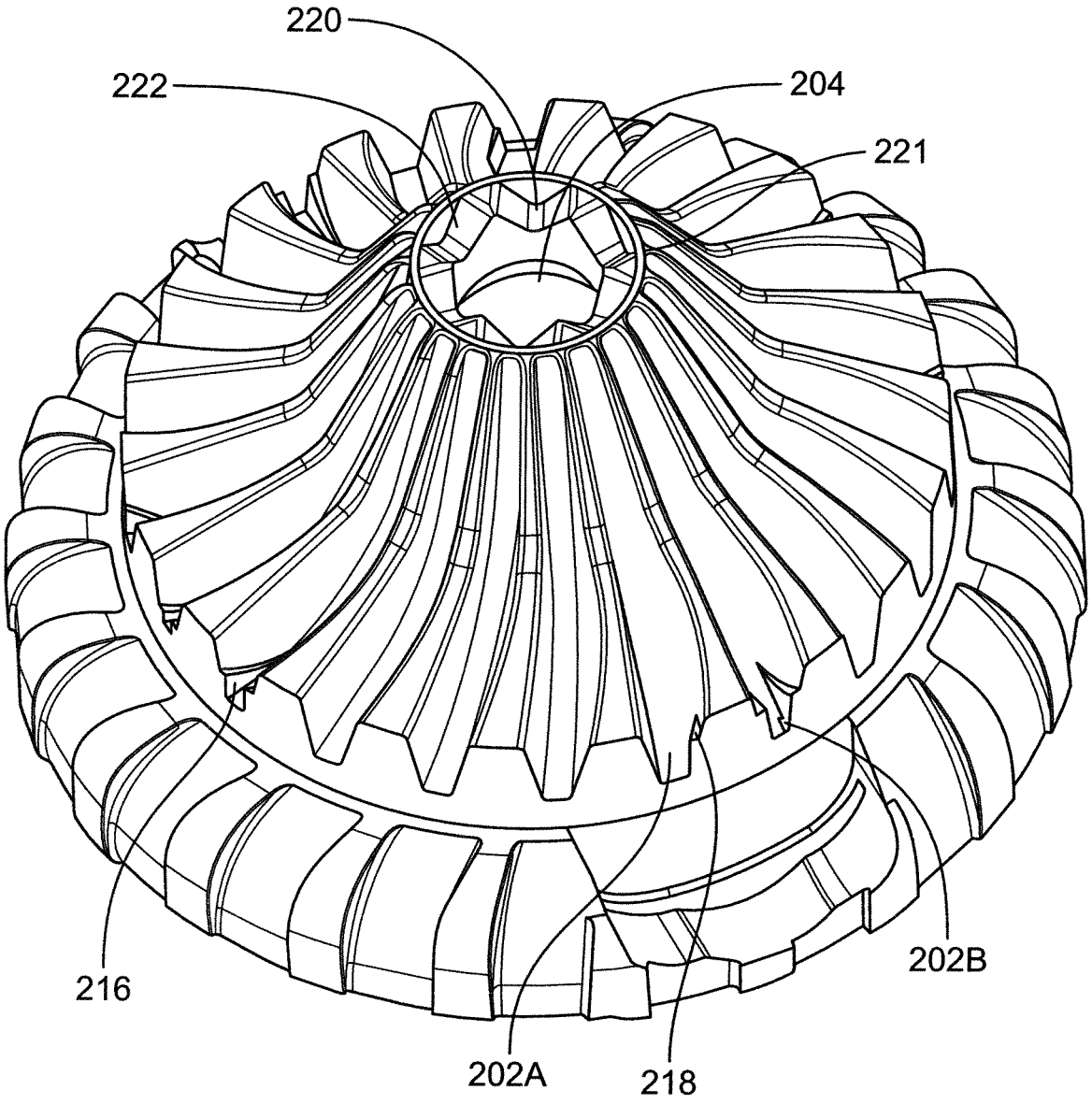
FIG. 16 is a perspective view of the deflector of FIG. 14.
Figure 17:
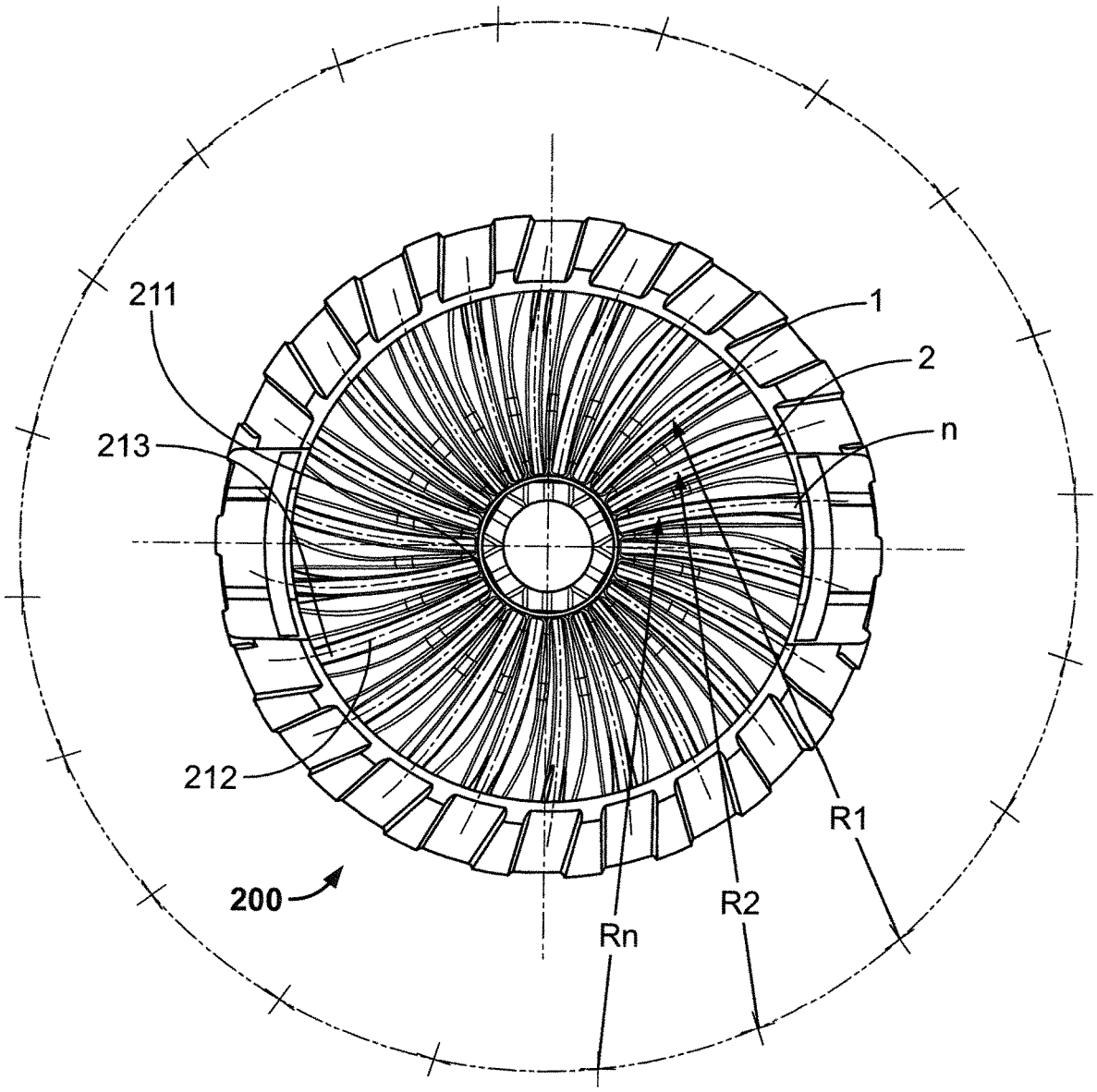
FIG. 17 is a schematic representation of the deflector of FIG. 14.

FIG. 17 shows a simplified representation of the basic flute geometry of the deflector 200 in the xy-plane, and each channel 212 extends from an inner end 211 to an outlet end 213. FIG. 16 has been annotated to show the curvature of the channels 212 relative to a center line through the channels 212, and the curvature is the same for all flutes 202. In this example, the deflector 200 shown includes 22 flutes, and flutes 1, 2, and n are marked for reference. Each of these flutes has its radius of curvature indicated by R1, R2, and Rn, and these radiuses of curvatures are the same. For instance, each flute (n) has the same radius of curvature (Rn) of 0.942", and the remaining flutes have the same radius of curvature. This deflector 200 may be used to produce an arcuate pattern about a nozzle with a maximum throw radius of 24'. As with deflector 100, these values for the number of flutes 202 and the uniform radius of curvature are just non-limiting examples, and it is generally contemplated that the deflector 200 may be designed with different numbers of flutes and with a different uniform radius of curvature so as to accommodate different throw radiuses.

As shown in FIG. 18, it is contemplated that the flute 202A includes an angled wall 218 that does not extend the entire height at the exit of the flute 202A. Instead, the angled wall 218 extends to only a partial height at the flute exit, such as, for example, to a height of about 75% at one side of a flute exit (although other heights may be desirable). The remainder of the wall is then not angled at all but is instead coextensive with the sidewall 208. The angled wall 218 forms an abrupt and immediate transition 219 defining edges and corners with respect to sidewall 208. In one form, these abrupt transitions 219 preferably define an angle of about 20 degrees between the side wall 208 and the angled wall 218. Again, this angular dimension is simply one example, and other angles may be desirable.

FIG. 15 shows one particular arrangement and combination of flutes with symmetric ramps 216 (flutes 202B) and with an angled wall of partial height 218 (flute 202A). More specifically, in this particular arrangement, there are three adjacent flutes 202B on one side (at the top of FIG. 15) that are on the opposite side of the deflector 200 from three other adjacent flutes 202B (at the bottom of FIG. 15). In addition, there is a single flute 202B (at the left side of FIG. 15) across from another single flute 202B (at the right side of FIG. 15). The deflector 200 also includes a single flute of flute type 202A. It is generally contemplated, however, that the deflector 200 may be modified so as include any of various combinations and arrangements of flutes 202A, 202B.

In some forms, the deflector 200 may not include any flutes 202A with angled walls 218 (whether partial height or full height). In other words, it is generally contemplated that the deflector 200 may include any of various numbers and combinations of flutes 202B. In addition, it is generally contemplated that deflector 200 may be modified so that flutes 202A, 202B are disposed at any of various locations on the deflector 200 with respect to one another, as may be desirable to adjust the performance of the deflector 200.

In addition, in one preferred form, as can be seen from FIG. 16, the bottom portion 222 of the deflector 200 preferably has recessed teeth 220. These recessed teeth 220 are arranged in a circumferential manner about the bore 204 of the deflector 200. These recessed teeth 220 are intended to engage with teeth 28, 28A projecting upwardly from the valve sleeve 16, 16A (FIGS. 3A, 5A), and therefore, have a shape configured to receive the valve sleeve teeth 28, 28A. As can be seen, deflector 100 includes downwardly projecting teeth 106 (FIG. 7), while deflector 200 includes recessed teeth 220. As should be evident, the recessed teeth 220 are not limited to the specific flute structure of deflector 200 and may be used on a deflector that includes any of various flute curvatures and any number and arrangement of the end-of-flute features discussed herein. Further, the recessed teeth 220 may be used on a deflector with no end-of-flute features.

It is believed that these recessed teeth 220 may provide certain advantages to the rotary nozzle 10 and to other rotary nozzles. For example, it is believed that the recessed teeth 220 help prevent wear and stripping of the deflector teeth 220 and the valve sleeve teeth 28, 28A. This wear and stripping may lead to failure of the teeth to engage properly, which may prevent the user from being able to adjust the arc in an arcuate pattern rotary nozzle. By recessing the teeth within the deflector 200, the deflector walls help protect the deflector teeth 220 and protect them from deforming or shearing. Also, the deflector walls limit any outward deformation of the valve sleeve teeth 28, 28*a*. It is believed that the deflector 200 will rotate and ratchet up and down with little (if any) stripping of the teeth.

In addition, it is believed that the protection against wear and stripping allows the use of narrower teeth in the rotary nozzle, and in one preferred form, the width of the valve sleeve teeth 28, 28A may be reduced to about 0.027 inches. In turn, the use of narrower valve sleeve teeth 28, 28A enables the use of a smaller diameter valve sleeve 16, 16A in the rotary nozzle. A reduced diameter valve sleeve 16, 16A in combination with the nozzle housing 18, 18A results in a wider exit orifice in the rotary nozzle. In one form, it is believed that the exit orifice may preferably be widened to a width greater than about 0.012 or 0.020 inches, which, in turn, leads to reduced clogging by debris passing through the orifice or the arcuate opening between the outer diameter of the valve sleeve 16, 16A and an inner diameter of the nozzle housing 18, 18A.

Further, recessing the deflector teeth 220 allows the deflector 200 to have a taller profile than deflector 100. By recessing the teeth 220, the deflector 200 can operate closer to the water stream exiting from the nozzle housing/valve sleeve and impacting the deflector 200. In other words, the clearance between the top of the nozzle body 17 and the bottom annular surface 221 of the deflector 200 can be reduced in the absence of downwardly projecting teeth. This taller profile may enable the use of longer flutes with a greater throw distance, if desired.

Also, the reduced clearance between the nozzle body 17 and deflector 200 has an additional benefit. When water initially flows through the rotary nozzle, the water lifts the deflector 200 from the valve sleeve 16, 16A and causes rotation of the deflector 200. It is believed the reduced clearance (resulting from the recessed teeth 220) may allow the deflector 200 to lift and disengage from the valve sleeve teeth 28, 28A at lower pressures. In turn, this activation at lower pressures may reduce the likelihood of the rotary nozzle stalling at such lower pressures.

Accordingly, in one form, there is disclosed a deflector for a rotary nozzle comprising: an underside surface including a plurality of flutes contoured to cause rotation of the deflector about a central axis when fluid impacts the underside surface and to redirect the fluid away from the underside surface in a plurality of streams; each of the plurality of flutes including a first sidewall and a second sidewall defining a channel therebetween, each channel extending from an inner end to an outlet end and defining a predetermined radius of curvature along at least a portion of the channel length from the inner end to the outlet end; and at least one of the plurality of flutes comprising: an angled wall at the outlet end of one of the channels, the angled wall defining an immediate transition with one of the first and second sidewalls of the flute such that the angled wall is not coextensive with the one of the first and second sidewalls.

In some implementations, in the deflector, the at least one of the plurality of flutes includes: a first flute with a first angled wall defining a first immediate transition with the first sidewall and angled in a first direction; and a second flute with a second angled wall defining a second immediate transition with the second sidewall and angled in a second direction opposite the first direction. In some implementations, the at least one of the plurality of flutes further includes: a third flute with a third angled wall defining a third immediate transition with the first sidewall and angled in the first direction; and a fourth flute with a fourth angled wall defining a fourth immediate transition with the second sidewall and angled in the second direction opposite the first direction. In some implementations, the third flute is adjacent the first flute; and the fourth flute is adjacent the second flute. In some implementations, the at least one of the plurality of flutes includes: a first flute with a first angled wall disposed on a first side of the deflector; and a second flute with a second angled wall disposed on a second side of the deflector opposite the first side. In some implementations, the at least one of the plurality of flutes further includes: a ramp opposite the angled wall at the outlet end of the channel, the angled wall defining a first immediate transition with one of the first and second sidewalls, and the ramp defining a second immediate transition with the other one of the first and second sidewalls and being adjacent therewith. In some implementations, one of the plurality of flutes does not include an angled wall and includes: a first ramp at the outlet end of one of the channels, the first ramp defining a first immediate transition with one of the first and second sidewalls and being adjacent therewith. In some implementations, the one of the plurality of flutes that does not include an angled wall further includes: a second ramp at the outlet end of the channel, the second ramp defining a second immediate transition with the other one of the first and second sidewalls and being adjacent therewith. In some implementations, the angled wall of the at least one of the plurality of flutes is angled in a direction of curvature of the channel or in a direction opposite the curvature of the channel. In some implementations, the at least one of the plurality of flutes includes: a first flute with a first angled wall angled in a direction of curvature of the channel; and a second flute with a second angled wall angled in a direction opposite the curvature of the channel. In some implementations, the angled wall of the at least one of the plurality of flutes defines a partial height relative to the one of the first and second sidewalls defining the immediate transition with the angled wall.

In another form, there is disclosed a deflector for a rotary nozzle comprising: an underside surface including a plurality of flutes contoured to cause rotation of the deflector about a central axis when fluid impacts the underside surface and to redirect the fluid away from the underside surface in a plurality of streams; each of the plurality of flutes including a first sidewall and a second sidewall defining a channel therebetween, each channel extending from an inner end to an outlet end and defining a predetermined radius of curvature along at least a portion of the channel length from the inner end to the outlet end; and at least one of the plurality of flutes comprising: a first ramp at the outlet end of one of the channels, the first ramp defining a first immediate transition with one of the first and second sidewalls and being adjacent therewith; and a second ramp at the outlet end of the channel, the second ramp defining a second immediate transition with the other one of the first and second sidewalls and being adjacent therewith.

In some implementations, in the deflector, the at least one of the plurality of flutes includes a first flute and a second flute, the first and second flutes on opposite sides of the deflector from one another. In some implementations, the at least one of the plurality of flutes further includes a third flute and a fourth flute, the third and fourth flutes on opposite sides of the deflector from one another. In some implementations, one of the plurality of flutes includes: an angled wall at the outlet end of one of the channels, the angled wall defining an immediate transition with one of the first and second sidewalls of the flute such that the angled wall is not coextensive with the one of the first and second sidewalls.

In another form, there is disclosed a deflector for a rotary nozzle comprising: an underside surface including a plurality of flutes contoured to cause rotation of the deflector about a central axis when fluid impacts the underside surface and to redirect the fluid away from the underside surface in a plurality of streams; each of the plurality of flutes including a first sidewall and a second sidewall defining a channel therebetween, each channel extending from an inner end to an outlet end and defining a predetermined radius of curvature along at least a portion of the channel length from the inner end to the outlet end; and a bottom portion defining a bore in the deflector, the bottom portion comprising a plurality of teeth recessed within the deflector.

In another form, there is disclosed a rotary nozzle comprising: a deflector comprising: an underside surface including a plurality of flutes contoured to cause rotation of the deflector about a central axis when fluid impacts the underside surface and to redirect the fluid away from the underside surface in a plurality of streams; each of the plurality of flutes including a first sidewall and a second sidewall defining a channel therebetween, each channel extending from an inner end to an outlet end and defining a predetermined radius of curvature along at least a portion of the channel length from the inner end to the outlet end; and at least one of the plurality of flutes comprising: an angled wall at the outlet end of one of the channels, the angled wall defining an immediate transition with one of the first and second sidewalls of the flute such that the angled wall is not coextensive with the one of the first and second sidewalls; and a nozzle body defining an inlet and an outlet, the inlet configured to receive fluid from a source and the outlet configured to deliver fluid to the underside surface of the deflector.

In some implementations, in the rotary nozzle, the at least one of the plurality of flutes of the deflector includes: a first flute with a first angled wall defining a first immediate transition with the first sidewall and angled in a first direction; and a second flute with a second angled wall defining a second immediate transition with the second sidewall and angled in a second direction opposite the first direction. In some implementations, the at least one of the plurality of flutes the deflector includes: a first flute with a first angled wall disposed on a first side of the deflector; and a second flute with a second angled wall disposed on a second side of the deflector opposite the first side. In some implementations, the angled wall of the at least one of the plurality of flutes defines a partial height relative to the one of the first and second sidewalls defining the immediate transition with the angled wall. In some implementations, one of the plurality of flutes includes: a first ramp at the outlet end of one of the channels, the first ramp defining a first immediate transition with one of the first and second sidewalls and being adjacent therewith; and a second ramp at the outlet end of the channel, the second ramp defining a second immediate transition with the other one of the first and second sidewalls and being adjacent therewith. In some implementations, the rotary nozzle further includes: an arc adjustment valve being adjustable to change an arcuate opening for the distribution of fluid from the deflector within a predetermined arcuate coverage, the valve comprising a first valve body and a second valve body configured to engage one another to adjust the arcuate opening. In some implementations, the deflector includes a first set of teeth recessed within the deflector and the first valve body includes a second set of teeth, the two sets of teeth configured for engagement with one another for setting the size of the arcuate opening. In some implementations, the rotary nozzle further includes: a first body and a second body downstream of the inlet and upstream of the deflector, the first body and the second body defining at least one flow path terminating at an annular exit orifice with the first body defining an inner radius of the annular exit orifice and the second body defining an outer radius of the annular exit orifice; wherein the annular exit orifice directs fluid against the deflector and defines a full circle coverage area.

It will be understood that various changes in the details, materials, and arrangements of parts and components which have been herein described and illustrated in order to explain the nature of the nozzle may be made by those skilled in the art within the principle and scope of the nozzle as expressed in the appended claims. Furthermore, while various features have been described with regard to a particular embodiment or a particular approach, it will be appreciated that features described for one embodiment also may be incorporated with the other described embodiments.

What is claimed is:

1. A deflector for a rotary nozzle comprising:

an underside surface including a plurality of flutes contoured to cause rotation of the deflector about a central axis when fluid impacts the underside surface and to redirect the fluid away from the underside surface in a plurality of streams;

each of the plurality of flutes including a first sidewall and a second sidewall defining a channel therebetween, each channel extending from an inner end to an outlet end and defining a predetermined radius of curvature along at least a portion of the channel length from the inner end to the outlet end, each channel extending outwardly in a radial direction from the inner end to define a linear inner portion and then extending into a curved outer portion having the predetermined radius of curvature, each curved outer portion extending in a same direction of curvature and defining the direction of curvature of the channels; and a first group of one or more flutes of the plurality of flutes, each flute in the first group comprising:

a first sidewall terminating in an angled wall at the outlet end of downstream of the curved portion of the channel, the angled wall defining an immediate transition with the first sidewall such that the angled wall is not coextensive with the first sidewall.

2. The deflector of claim 1, wherein the first group of the plurality of flutes comprises:

a first flute with a first angled wall angled in a first direction that is in the direction of curvature of the channels; and a second flute with a second angled wall angled in a second direction opposite the first direction, the second direction being opposite the direction of curvature of the channels.

3. The deflector of claim 2, wherein the first group of the plurality of flutes further comprises:

a third flute with a third angled wall angled in the first direction in the direction of curvature of the channels; and a fourth flute with a fourth angled wall angled in the second direction opposite the first direction.

4. The deflector of claim 3, wherein:

the third flute is directly adjacent the first flute; and the fourth flute is directly adjacent the second flute.

5. The deflector of claim 1, wherein the first group of the plurality of flutes comprises:

a first flute with a first angled wall disposed on a first side of the deflector; and a second flute with a second angled wall disposed on a second side of the deflector opposite the first side.

6. The deflector of claim 1, wherein at least one flute of the first group further comprises:

a ramp opposite the angled wall at the outlet end of the channel, the angled wall defining a first immediate transition with the first sidewall, and the ramp decreasing the depth of at least a portion of the channel when approaching the outlet end and defining a second immediate transition with the second sidewall and being adjacent therewith.

7. The deflector of claim 1, further including a second group of one or more flutes of the plurality of flutes, each flute in the second group comprising:

a first ramp decreasing the depth of at least a portion of the channel when approaching the outlet end of the channel, the first ramp defining a first immediate transition with the first sidewall and being adjacent therewith; and a second sidewall not terminating in an angled wall at the outlet end downstream of the curved portion of the channel.

8. The deflector of claim 7, wherein each flute of the second group further comprises:

a second ramp decreasing the depth of at least a portion of the channel when approaching the outlet end of the channel, the second ramp defining a second immediate transition with the second sidewall and being adjacent therewith.

9. The deflector of claim 1, wherein the angled wall of at least one flute in the first group is angled in a direction opposite the curvature of the channel.

10. The deflector of claim 1, wherein the angled wall of at least one flute in the first group defines a partial height relative to the first sidewall defining the immediate transition with the angled wall.

11. A deflector for a rotary nozzle comprising:

an underside surface including a plurality of flutes contoured to cause rotation of the deflector about a central axis when fluid impacts the underside surface and to redirect the fluid away from the underside surface in a plurality of streams;

each of the plurality of flutes including a first sidewall and a second sidewall defining a channel therebetween, each channel extending from an inner end to an outlet end and defining a predetermined radius of curvature along at least a portion of the channel length from the inner end to the outlet end, each channel extending outwardly in a radial direction from the inner end to define a linear inner portion and then extending into a curved outer portion having the predetermined radius of curvature, each curved outer portion extending in a same direction of curvature and defining the direction of curvature of the channels; and a first group of one or more flutes of the plurality of flutes, each flute in the first group comprising:

a first ramp decreasing the depth of at least a portion of the channel when approaching the outlet end of the channel, the first ramp defining a first immediate transition with the first sidewall and being adjacent therewith; and a second ramp decreasing the depth of at least a portion of the channel when approaching the outlet end of the channel, the second ramp defining a second immediate transition with the second sidewall and being adjacent therewith.

12. The deflector of claim 11, wherein the first group of the plurality of flutes comprises a first flute and a second flute, the first and second flutes on opposite sides of the deflector from one another.

13. The deflector of claim 12, wherein the first group of the plurality of flutes further comprises a third flute and a fourth flute, the third and fourth flutes on opposite sides of the deflector from one another.

14. The deflector of claim 11, further including a second group of one or more flutes of the plurality of flutes, each flute in the second group comprising:

a first sidewall terminating in an angled wall at the outlet end of downstream of the curved portion of the channel, the angled wall defining an immediate transition with the first sidewall of the flute such that the angled wall is not coextensive with the first sidewall;

a second sidewall not terminating in an angled wall at the outlet end downstream of the curved portion of the channel.

15. A deflector for a rotary nozzle comprising:

an underside surface including a plurality of flutes contoured to cause rotation of the deflector about a central axis when fluid impacts the underside surface and to redirect the fluid away from the underside surface in a plurality of streams;

each of the plurality of flutes including a first sidewall and a second sidewall defining a channel therebetween, each channel extending from an inner end to an outlet end and defining a predetermined radius of curvature along at least a portion of the channel length from the inner end to the outlet end; and a bottom portion defining a bore in the deflector, the bottom portion comprising a plurality of teeth recessed within the deflector.

16. A rotary nozzle comprising:

a deflector comprising:

an underside surface including a plurality of flutes contoured to cause rotation of the deflector about a central axis when fluid impacts the underside surface and to redirect the fluid away from the underside surface in a plurality of streams;

each of the plurality of flutes including a first sidewall and a second sidewall defining a channel therebetween, each channel extending from an inner end to an outlet end and defining a predetermined radius of curvature along at least a portion of the channel length from the inner end to the outlet end, each channel extending outwardly in a radial direction from the inner end to define a linear inner portion and then extending into a curved outer portion having the predetermined radius of curvature, each curved outer portion extending in a same direction of curvature and defining the direction of curvature of the channels; and a first group of one or more flutes of the plurality of flutes, each flute in the first group comprising:

a first sidewall terminating in an angled wall at the outlet end of downstream of the curved portion of the channel, the angled wall defining an immediate transition with the first sidewall such that the angled wall is not coextensive with the first sidewall; and a nozzle body defining an inlet and an outlet, the inlet configured to receive fluid from a source and the outlet configured to deliver fluid to the underside surface of the deflector.

17. The rotary nozzle of claim 16, wherein the first group of the plurality of flutes comprises:

a first flute with a first angled wall angled in a first direction that is in the direction of curvature of the channels; and a second flute with a second angled wall angled in a second direction opposite the first direction, the second direction being opposite the direction of curvature of the channels.

18. The rotary nozzle of claim 16, wherein the first group of the plurality of flutes comprises:

a first flute with a first angled wall disposed on a first side of the deflector; and a second flute with a second angled wall disposed on a second side of the deflector opposite the first side.

19. The rotary nozzle of claim 16, wherein the angled wall of at least one of the flutes in the first group defines a partial height relative to the first sidewall defining the immediate transition with the angled wall.

20. The rotary nozzle of claim 16, further including a second group of one or more flutes of the plurality of flutes, each flute in the second group comprising:

a first ramp decreasing the depth of at least a portion of the channel when approaching the outlet end of the channel, the first ramp defining a first immediate transition with the first sidewall and being adjacent therewith; and a second ramp decreasing the depth of at least a portion of the channel when approaching the outlet end of the channel, the second ramp defining a second immediate transition with the second sidewall and being adjacent therewith.

21. The rotary nozzle of claim 16, further comprising:

an arc adjustment valve being adjustable to change an arcuate opening for the distribution of fluid from the deflector within a predetermined arcuate coverage, the valve comprising a first valve body and a second valve body configured to engage one another to adjust the arcuate opening.

22. The rotary nozzle of claim 21, wherein:

the deflector includes a first set of teeth recessed within the deflector and the first valve body includes a second set of teeth, the two sets of teeth configured for engagement with one another for setting the size of the arcuate opening.

23. The rotary nozzle of claim 16, further comprising:

a first body and a second body downstream of the inlet and upstream of the deflector, the first body and the second body defining at least one flow path terminating at an annular exit orifice with the first body defining an inner radius of the annular exit orifice and the second body defining an outer radius of the annular exit orifice;

wherein the annular exit orifice directs fluid against the deflector and defines a full circle coverage area.

24. The deflector of claim 1, further comprising a second sidewall not terminating in an angled wall at the outlet end downstream of the curved portion of the channel.

* * * * *